US005385467A

United States Patent [19]

Sebastiani et al.

[11] Patent Number: 5,385,467

[45] Date of Patent: Jan. 31, 1995

[54] METHODS AND APPARATUS FOR GAS COMBUSTION

[75] Inventors: Enrico Sebastiani, Legnano; Giuseppe Fogliani, Formigine, both of Italy

[73] Assignee: Worgas Bruciatori S.r.l., Modena, Italy

[21] Appl. No.: 965,418

[22] PCT Filed: Jul. 5, 1991

[86] PCT No.: PCT/IT91/00056

§ 371 Date: Dec. 28, 1992

§ 102(e) Date: Dec. 28, 1992

[87] PCT Pub. No.: WO92/01196

PCT Pub. Date: Jan. 23, 1992

[30] Foreign Application Priority Data

Jul. 6, 1990 [IT] Italy ..... 40099 A/90
Jan. 14, 1991 [IT] Italy ..... MO 91 A 00008

[51] Int. Cl.[6] ..... F23D 3/40; F23C 5/00

[52] U.S. Cl. ..... 431/326; 431/8; 431/354; 239/559

[58] Field of Search ..... 431/326, 354, 8, 328; 239/559, 553, 557

[56] References Cited

U.S. PATENT DOCUMENTS 3,445,175 5/1969 Krieger ..... 431/328
3,936,003 2/1976 Hapgood et al. ..... 239/559
4,169,430 10/1979 Cheetham ..... 122/25

FOREIGN PATENT DOCUMENTS 0047048 3/1982 European Pat. Off. ..... F23D 13/36
WOA89/011-16 2/1989 WIPO ..... F23D 14/10

*Primary Examiner*—Larry Jones
*Attorney, Agent, or Firm*—Albert C. Smith

[57] ABSTRACT

In a method of combustion designed to achieve a further reduction in harmful emissions, especially of NOx and CO, which is viable at advantageously reduced noise levels and lower cost with any burner of a type comprising a slotted or pierced diffuser of thin sheet metal in receipt of fully or partly mixed gas and air supplies, typically in appliances comprising a heat exchanger such as the boilers of central heating systems, the essential steps are: a) supplying a uniform flow of fuel-air mixture to the slots; b) discharging the mixture from a pierced surface of substantially doughnut geometry comprising a slotted peripheral area (Ap) and an essentially solid central area (Ac) of prescribed proportions; c) bringing combustion to completion in a slender lamellar flame; d) regulating the rate of aeration to a value between 0.9 and 1.4, or e) to values less than 1.6; f) effecting a recycle of post-combustion gases.

42 Claims, 21 Drawing Sheets

Fig.8
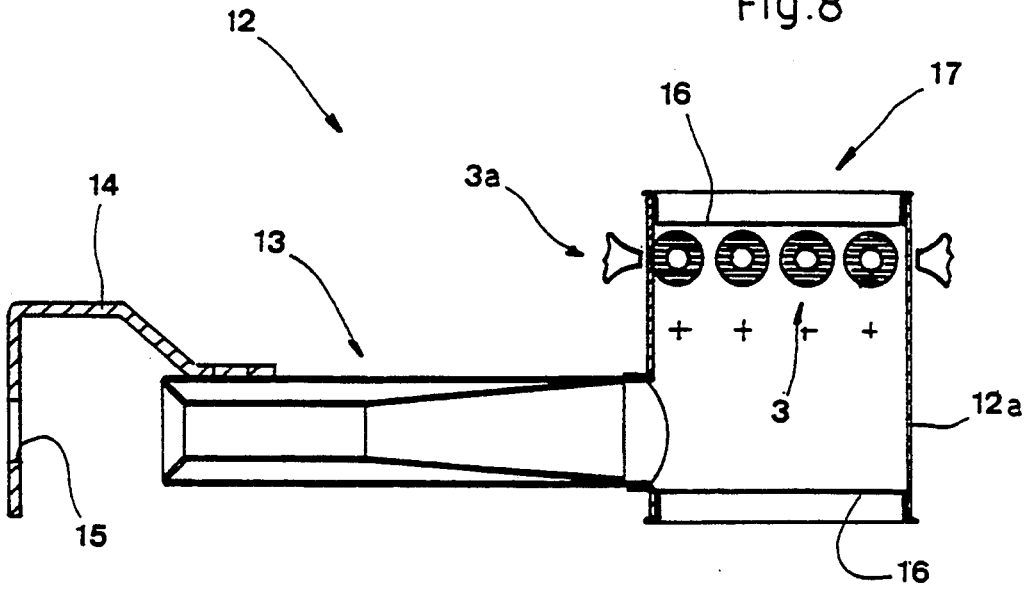
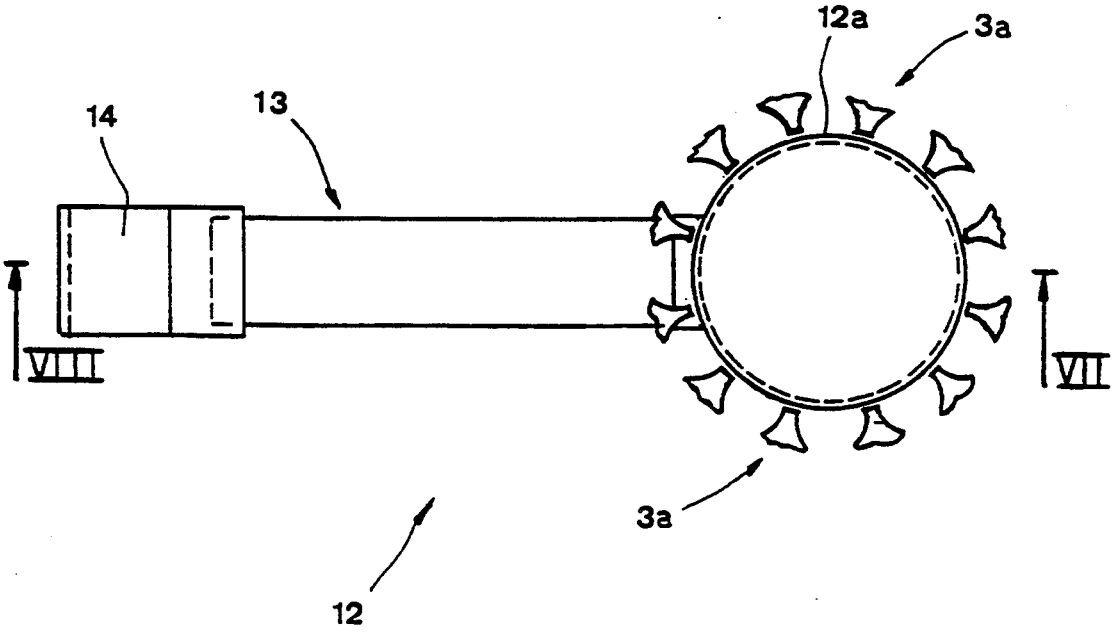
Fig.7

Fig.10a
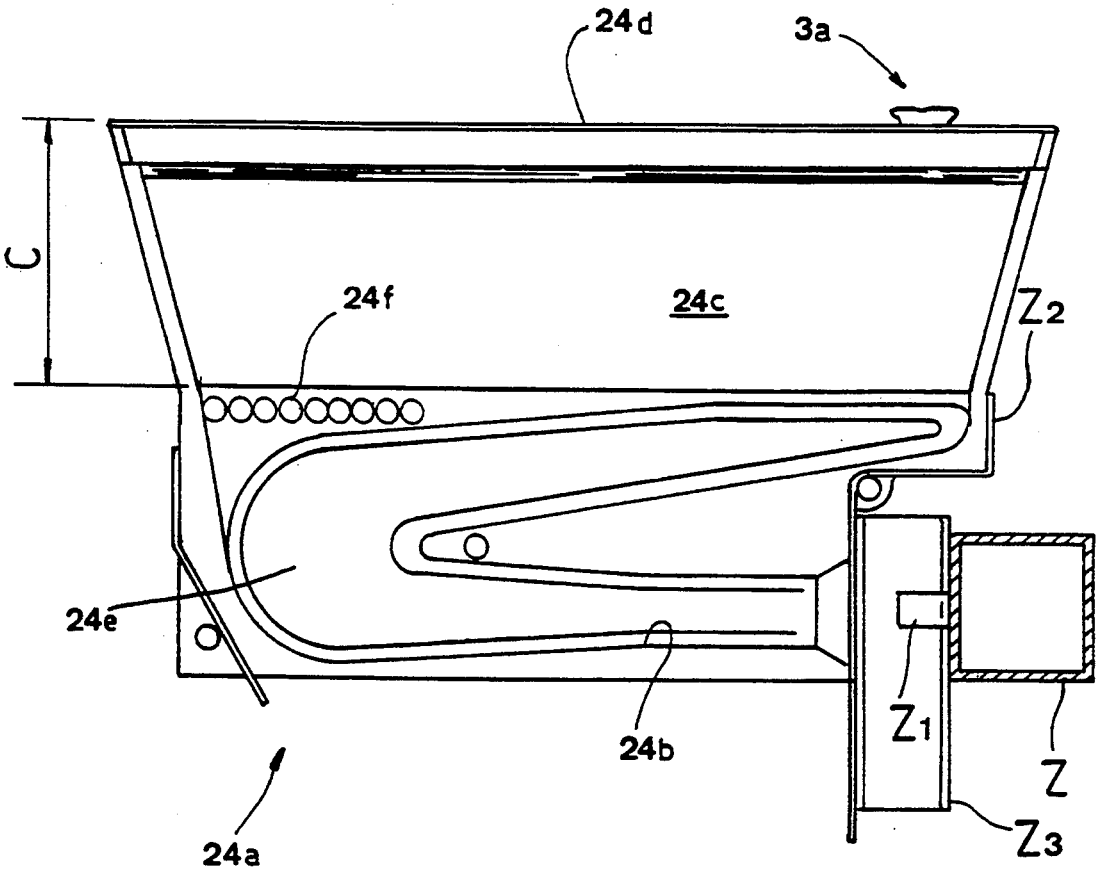
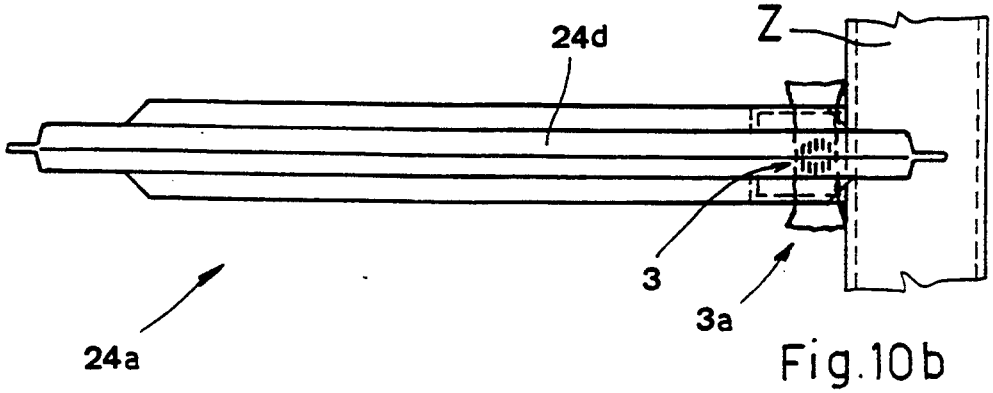
Fig.10b

40

41

42

43

44

45

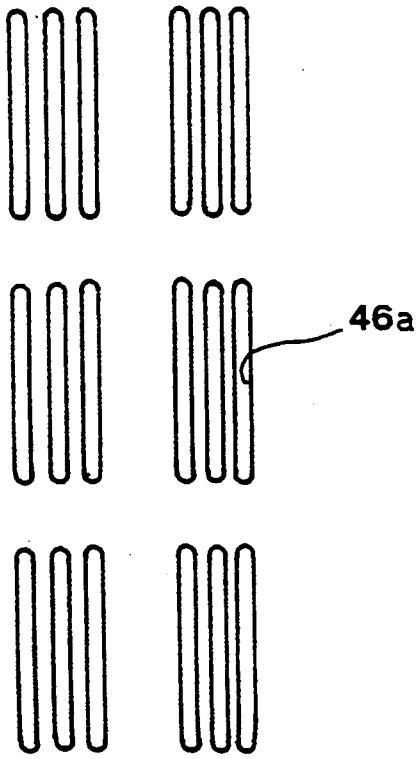
Fig. 38a
Fig. 38b
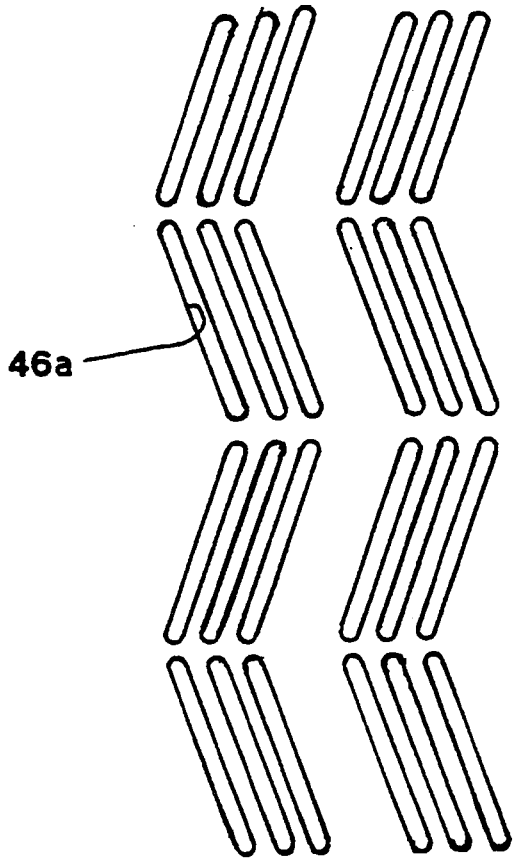

Fig.48
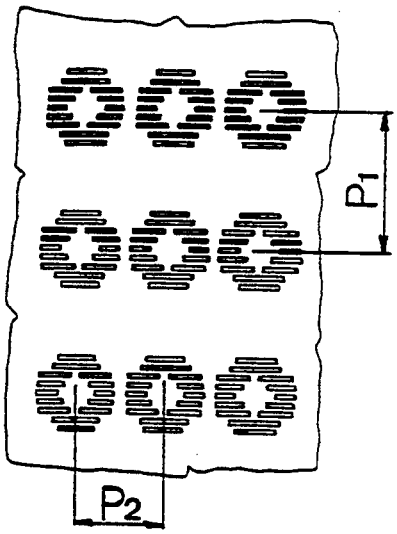
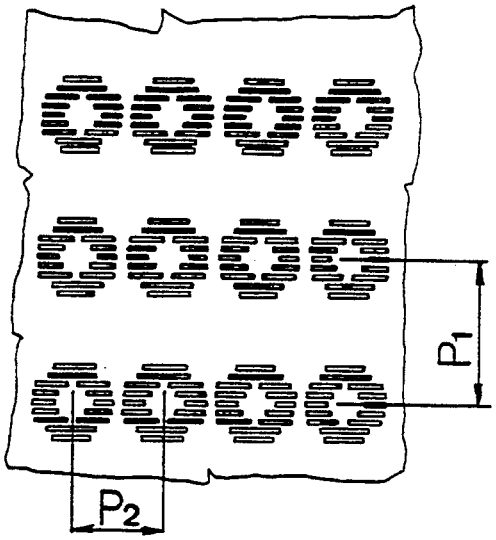
Fig.49
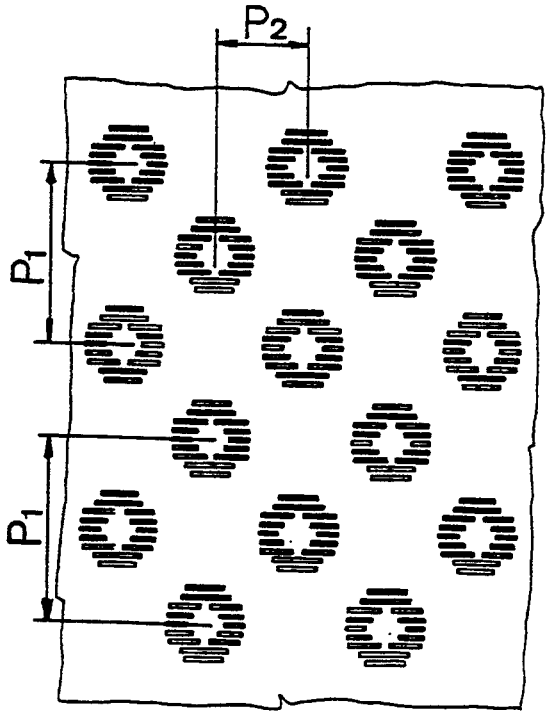
Fig.47
Fig.50
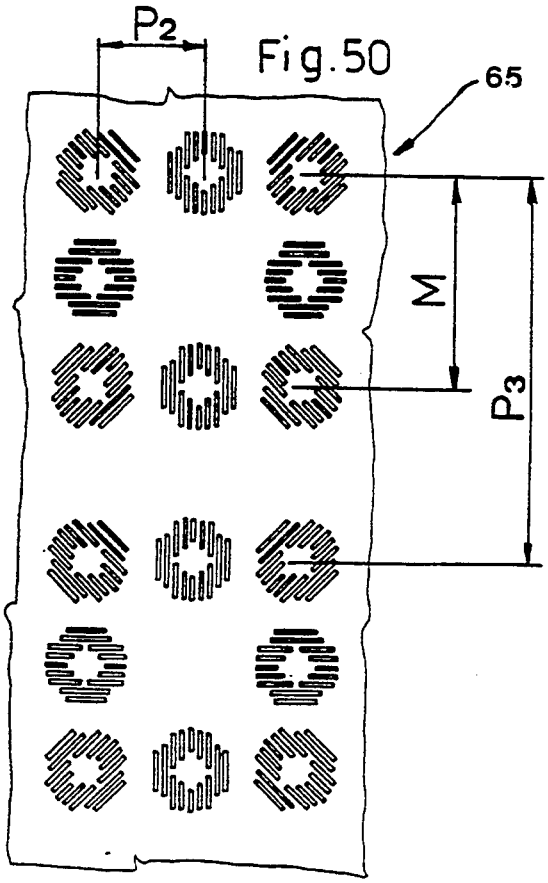

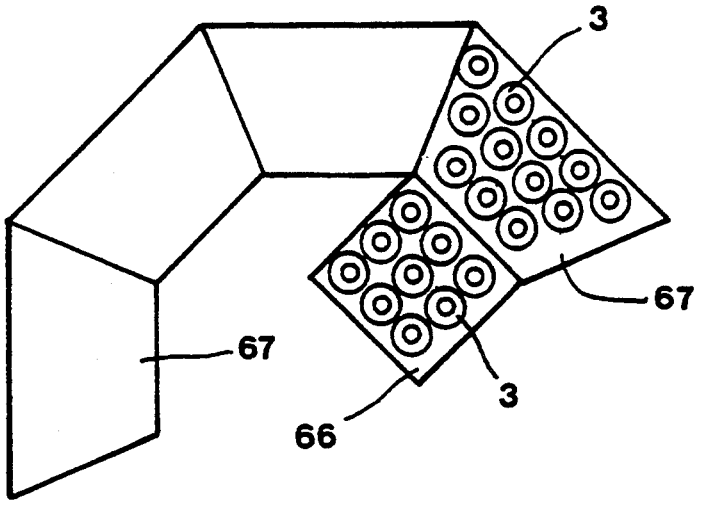
Fig.51
Fig.52
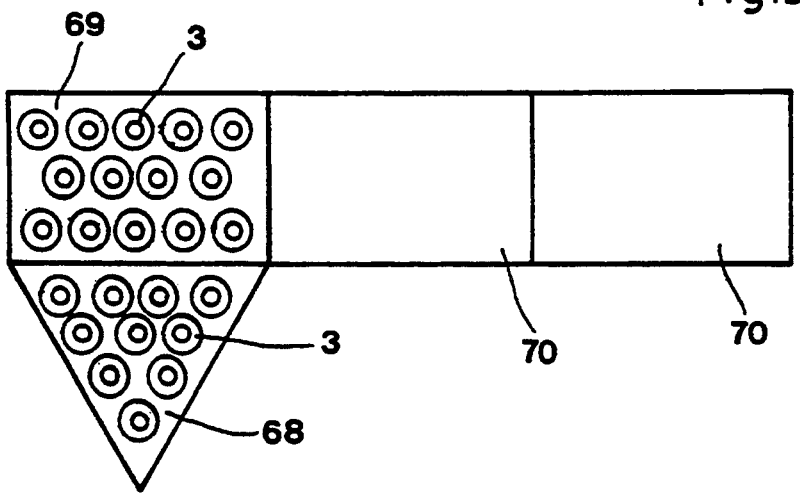
Fig.53
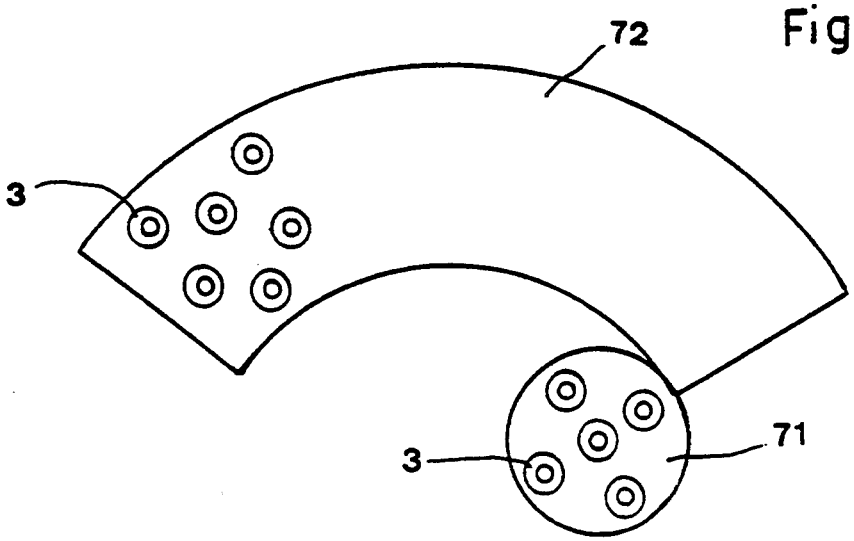

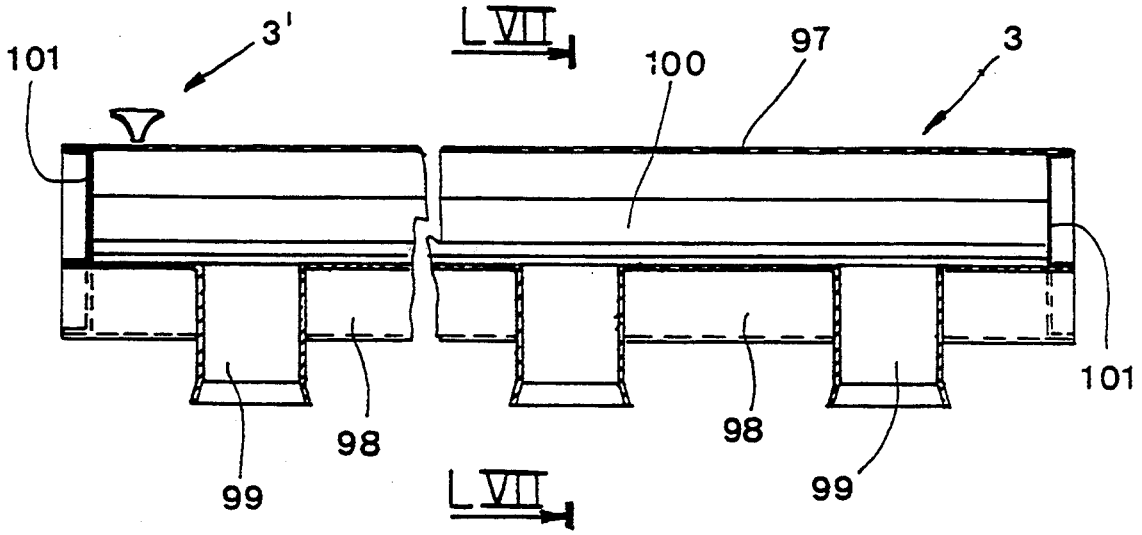
Fig.56
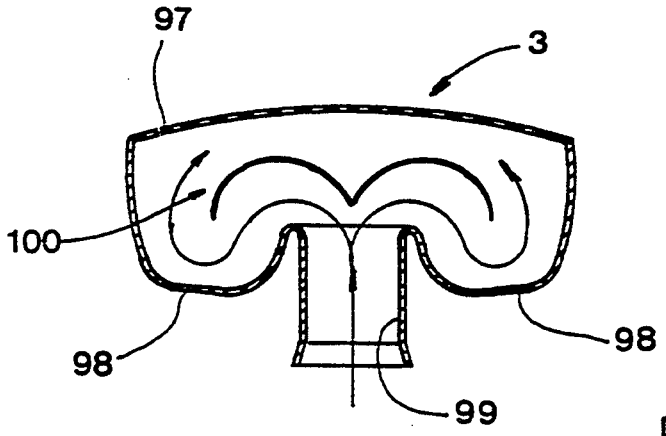
Fig.57
Fig.58
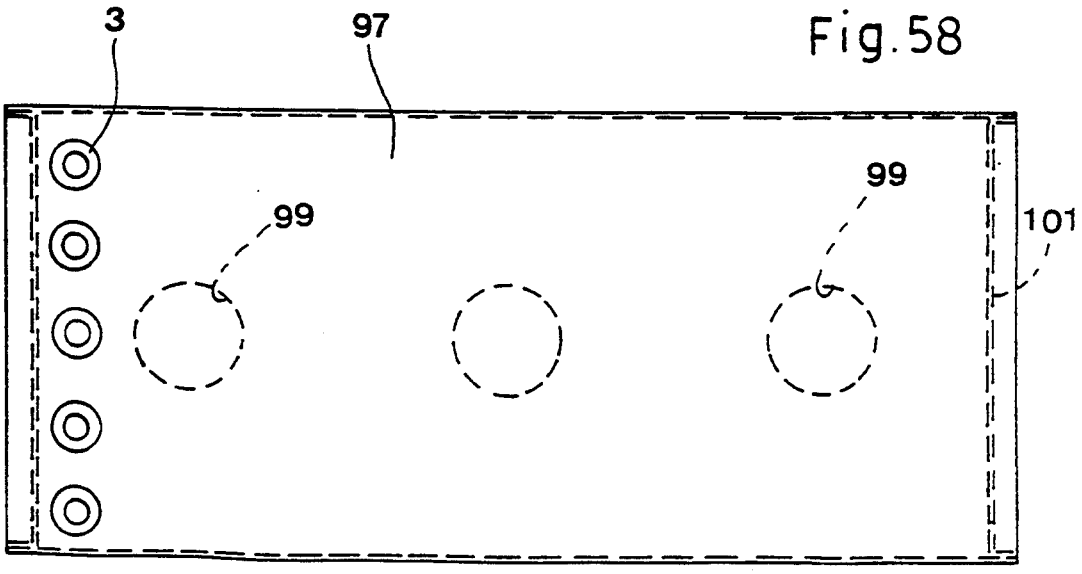

METHODS AND APPARATUS FOR GAS COMBUSTION

SUMMARY OF THE INVENTION

The invention relates to a method of bringing about the combustion of gases while controlling harmful emissions, and to the relative burner and system, that is, a new procedure by which to obtain thermal energy from gases such as methane, butane, propane or others, and blends thereof, whether by supplying the gas-air mixture to the burner partly premixed, i.e. with an aeration rate (the ratio between the effective quantity of air present in a given volume of the mixture and the quantity required to bring about stoichiometric combustion in the same volume) less than or equal to 1, or by supplying a mixture totally premixed, that is, with an aeration rate higher than 1, in such a way that harmful emissions (principally NOx and CO) are either eliminated completely or reduced to negligible levels; such a method is implemented by means of a burner and variable power fuel feed system also constituting subject matter of the disclosure. The prior art embraces a method of bringing about gas combustion at low NOx and CO emission levels as disclosed in application for international patent number PCT/IT 87/00079 filed Mar. 8, 1987 by the same applicant, which comprises the steps of:

aspirating a quantity of primary air equal to at least 80% of the quantity stoichiometrically required;

directing a quantity of secondary air to the single flames, from the start of combustion, in excess of 100% of the stoichiometric value;

bringing combustion to completion internally of a thin flame of lamellar configuration, evidence of which, in the case of natural gas, is the emission of a violet colour of wavelength less than 0.42 nm.

For the implementation of such a method, the above application discloses exclusively an atmospheric burner, that is, a burner connected into a circuit through which fuel and air circulate naturally, in association with a horizontally disposed tubular diffuser affording groups of slots for the passage of the fuel and primary air mixture, distributed over the surface of the diffuser in successive sets extending transversely to its axis, which are set apart one from the next by an amount equal to nd/2, where d is the axial length of the group and n is the number of groups in each set, or the number of groups in two successive sets in the case of a chequered distribution pattern; the distance which separates the groups of slots of one set in the transverse direction is equivalent to at least 65% of the length of the longest slot of one group.

Each group generates a lamellar flame appearing as a pair of divergent wings, butterfly-like in form, of which the axis of symmetry coincides with the longitudinal median plane of each group.

Whilst reflecting notable progress in the control of emissions, particularly NOx and CO, the method set forth in the aforementioned PCT application in effect neither envisages nor permits of feeding the diffuser with mixtures containing percentages of oxygen close to or exceeding stoichiometric values; neither can combustion be sustained in the presence of post-combustion gases, due to the instability of the flame and consequent impossibility of operation in these particular conditions, a fact attributable to the limitations of the method and of the design of the burner, both separately and in combination.

With regard to the control of output variations and feed, the prior art embraces devices as in patents DE 3010014 and DE 3018752, both filed in 1980.

The former discloses regulation of the combustion assisting air by governing pressure upstream and downstream of the combustion chamber, which can be achieved by the installation of a diaphragm, in conjunction with control over the pressure of the gas supplied to the burner nozzles. The latter discloses a nozzle with two chambers in series, of which the outlet sections are controlled by respective obturators associated with a single stem, in conjunction with means by which to control both the flow of primary air and the flow of the fuel-air mixture.

In both devices, there is the disadvantage that a high rate of aeration cannot be achieved without specifying notably large dimensions both for the device itself and for the Venturi tube, hence for the body of the burner in the event that the tube is incorporated internally.

As to the width of horizontally disposed tubular burners, the dimensions of the corresponding cross section are considered to be excessive in some instances.

The prior art thus stands in need of considerable improvement with regard to overcoming the drawbacks mentioned above.

Accordingly, the objects of the invention are to provide a method of combustion such as will ensure notable stability of a flame in any given condition under which gas is supplied to the relative burner, for example by varying the type of gas or its rate of flow at the nozzle outlet, and in any condition of operation, with fuel and air premixed totally or in part, or of installation of the burner, whether in atmospheric or forced circuits, in such a way that harmful emissions, $NO_x$ and CO especially, can be reduced either to zero or to negligible values (e.g. of the order of the standard error adopted for measuring instruments); and in implementing such a method to achieve a stable flame of lamellar configuration with the diffuser in receipt of fuel and air mixed either in hyperstoichiometric or near-stoichiometric proportions, notwithstanding combustion may occur in an environment wholly or partly occupied by combusted gases, with a diffuser disposed not only horizontal but also vertical, sub-vertical or howsoever, and in a burner of cylindrical, conical, parallelepiped or whatever embodiment whether as selected, or imposed by the geometry and location of the heat exchanger hence also of the combustion chamber; also to ensure combustion conditions such as will enable a smooth transition from ignition to steady burn, obtaining a stable flame and full combustion even with power in modulation and in extreme operating conditions, and to ensure that combustion occurs remotely from the diffuser, thereby contriving to prevent over-heating and avoid the need for substitution of the relatively low cost sheet metal usually employed with more expensive refractories, which are often fragile; and finally, to achieve all of the above at a markedly reduced or restrained cost and with negligible noise levels.

The stated objects are achieved though the adoption of a method consisting in a combination of the following steps:

A) feeding the slots of the diffuser uniformly with a homogeneous mixture of air and combustible gas;

B) efflux of the mixture from slots each exhibiting a width dimension that may be as much as equal to the depth, as considered in the direction of the efflux, or marginally greater, according to the type of gas, arranged in groups around relative central zones that are either unpierced or may be pierced over an area measuring no more than 20% of the overall area of the central zone itself; to advantage, the ratio between the area of the peripheral zone occupied by the slots and the area of the central zone is between 3 and 10, and the ratio between the area of the slots and the area of the peripheral zone between ½ and ⅓.5, the central zone being of width up to 3 mm maximum, and of any given length; the groups of slots may be distributed in repeated rows oriented in any given direction, aligned or staggered;

C) commencement and completion of combustion, brought about instantaneously and in a single stage at each group of slots in slender lamellar flames with a hyperstoichiometric mixture of fuel and air which, in the case of natural gas (methane) is reflected in the emission of violet radiation of wavelength less than 0.42 fm; the flames of each group combine to create the impression of butterfly wings, tulip corolla, trumpet, campanula or similar, regularly formed or otherwise, springing divergently from a level immediately above and at less than 2 mm from the surface of the diffuser, the axis or plane of symmetry disposed perpendicular to a tangential plane passing through the centre of each group, thereby obtaining a saturated volume of fully combusted gases, encompassed externally by the flames of each group and spreading with the increase in distance from the diffuser, in which the partial pressure of the oxygen is further reduced, and a slow recirculation of combusted gases occurring at the base of the volume such as will maintain temperatures sufficient to allow ignition;

D) in operation at a variable rate of aeration, lower even than 1.1, with natural or forced circulation of combusted air and gases and with specific loading on the diffuser (ratio between thermal power output and the surface area of the flame outlets) of between 0.3 and 0.8 $kW/cm^2$, regulation of the aeration rate to within values of 0.9, related to operation at maximum output, and 1.4, related to operation at minimum output and starting; and with an aeration rate less than or equal to 1.1, induction of the quantity of air required to effect full combustion in a partial vacuum created by the jet of fuel-air mixture issuing from the slots to invest the external face of the lamellar flames;

E) in operation with a rate of aeration permanently above 1.1, with natural or forced circulation of combusted air and gases, regulation of the rate to values no higher than 1.6 and advantageously between 1.1 and 1.3, whether at maximum output or in the starting or modulating modes, with specific loading on the diffuser of between 0.3 and 0.8 $kW/cm^2$; supply pressure of the gas fuel being, to advantage, between 100 and 450 mbar;

F) diversion of the combusted gases by induction into a partial vacuum created with the jet of fuel-air mixture issuing from the slots to invest the external face of the lamellar flames, having been cooled and mixed with air at a rate of between 0 and 100%, with the result that the partial pressure of the oxygen is reduced during combustion by the gases, and the excess of air also limited, thus benefiting efficiency;

G) diversion of the combusted gases by induction into a partial vacuum created with the jet of fuel-air mixture issuing from the slots to invest the external face of the lamellar flames, having been cooled and mixed with air at a rate of between 10 and 100%, with the result that the partial pressure of the oxygen is reduced during combustion by the gases, and the excess of air also limited, thus benefiting efficiency.

The following are preferred combinations of the steps of the method as recited above, related to possible fuel feed conditions:

A, B, C, D
A, B, C, E
A, B, C, D, G
A, B, C, E, F

As to the preferred burner for implementation of such a method, the stated objects are realized by adopting a diffuser with slots distributed in groups, each group consisting in a peripheral zone encompassing a central zone either devoid of slots or pierced over an area limited to no more than 20% of the area of the central zone itself, occupying a surface, advantageously, of between 5 and 40 mm) such that the ratio between the area of the peripheral zone and the area of the central zone is advantageously between 3 and 10, and the ratio between the area of the slots and the area of the peripheral zone is between ½ and ⅓.5, whilst for a maximum width of the central zone measuring approximately 3 mm the corresponding length can assume any given value; the groups of slots can be distributed for example in longitudinally repeated transverse rows, and the width of a single slot can be equal to the thickness of the diffuser wall, or marginally greater, according to the type of gas.

The burner may be provided with a Venturi tube, disposed internally or externally of the body of the diffuser about a rectilinear axis or otherwise and vertical or horizontal, angled or skew, whilst the body of the diffuser itself may be of tubular section, cylindrical or prismatic and tapered, pyramidal, or rectangular and elongated, and embodied with groups of slots preferably of rectangular geometry, or of openings in general, occupying its surface entirely or in part.

For installation in circuits where the circulation of post-combustion gas and air is forced, and advantage is gained from a maximum reduction in height, the preferred burner exhibits a body of cross section appearing bilobed at bottom to create a pair of lateral channels situated below a flat diffuser marginally arched in profile and outwardly convex, or indeed of any suitable profile and incorporating the slots or openings according to the invention, with central inlet ports at bottom distributed longitudinally between the two bilobed formations and directing the flow of mixture into two diverging branches of sinuous curvilinear axis and progressively increasing section, which are separated from the diffuser by a longitudinal baffle straddling the division of the branches and exhibiting a cross section of upturned minuscule omega profile extending the length of the burner.

As to the fuel feed system, and the difficulties connected with regulating the power output while holding the rate of aeration steady between limits according to the method disclosed, where a natural current induced in the circuit carrying combusted air and gas is sufficient to sustain complete combustion, or where forced circulation is produced with a fan, these are overcome by adopting a gas nozzle of variable outlet section consisting in a proportioning element with a conical forward end, having a critical taper angle between 0 and 10 and capable of guided axial movement internally of an orifice formed in the body of the nozzle of which the taper angle is equal or approximately equal to that of the proportioning element, thus obtaining a progressive reduction in gas pressure at the outlet through the reduction in section of the orifice in respect of the reduction in the rate of aeration with variation in flow, hence in output; the rear end of the proportioning element is fashioned as a plate biased into contact with the lateral surface of a manually or automatically operated cam by a spring.

Advantageously, operating with forced circulation of the combusted gas and air, use is made of a variable speed centrifugal compressor providing delivery pressures of between 100 and 450 mbar and enabling partial recycle of the mixture, of which the inlet circuit is equipped with alternating on/off valves installed on the air and gas lines.

Advantages of the invention are: a reduction in the level of harmful emissions, especially NOx and CO, to values corresponding to the standard permissible errors adopted for measuring instruments; a further reduction in noise levels; an extension of the benefits of lower emissions and noise levels to all possible designs of burner with thin sheet metal diffusers (0.2 mm to thicknesses even in excess of 2 mm) in receipt of fuel and air mixed either fully or in part, installed in circuits through which combusted air and gas circulate either naturally or forcibly, also with output-modulated circuits; increased specific thermal output; a lamellar flame of notable stability, even with fuel and air mixed in hyperstoichiometric proportions, and/or in the transition from ignition to steady burn, and/or when combustion occurs in an environment totally or partly occupied by combusted gases; the continued presence of a temperature at the base of the flame sufficiently high to sustain ignition though not so high as to damage the sheet metal by overheating or to necessitate the adoption of diffusers in ceramic material or other materials affording resistance to high temperatures; a notable reduction in costs; the provision of a functional, simple and economic device for regulating output; a reduction in burner height, where desirable; a further reduction in the distance separating heat exchanger and diffuser.

BRIEF DESCRIPTION OF THE DRAWING

The invention will now be described in detail, by way of example, with the aid of the twenty-one accompanying sheets of drawings, in which groups of slots are illustrated generically in shape and number as if occupying a flat surface, though the surface might in effect be curved or cuspidate:

FIG. 7 is the view from above of a burner with a tubular cylindrical diffuser according to the invention, disposed with axis vertical and associated with an external and perpendicularly disposed Venturi tube, and with groups of slots distributed around the uppermost part of the lateral surface of the diffuser;

FIG. 8 is a longitudinal and vertical section through VIII—VIII in FIG. 7;

FIG. 10*a* is the side elevation of a slimline burner element for assembly in banked formation, with groups of slots distributed along the top of the diffuser, which exhibits a cuspidate profile with pitched surfaces mutually angled at 90° or more;

FIG. 10*b* is the plan of FIG. 10*a;*

FIG. 38*a* is a plan showing groups of at least three elongated rectangular slots each, advantageously six in number and divided into two sub-groups in which the slots are disposed parallel at a constant distance between centres and bordering a central zone of width less than or equal to 3 mm, by way of example, the distance between groups being between 1 and 4 mm, for example, and disposed along a rectilinear axis parallel to that of the slots;

FIG. 38*b* is a plan showing groups of slots similar to those of FIG. 38*a*, in this instance bordering on a central zone exhibiting a zigzagging rectilinear axis;

FIGS. 44, 45, 46 and 47 are developed views of part of the surface of a diffuser, showing groups of slots arranged and aligned respectively in two, three, four or five rows, parallel with the axis of the diffuser and staggered one from the next;

FIGS. 48 and 49 are views showing part of the diffuser of a burner according to the invention, with groups of slots distributed in alignment along two directions perpendicular one to another;

FIG. 50 is a view similar to that FIG. 43, with groups of slots arranged in square formation;

FIGS. 51, 52 and 53 are the developed views of diffusers exhibiting square frusto-pyramidal, triangular prismatic and frustoconical geometry, respectively;

FIG. 56 is the longitudinal section through a low profile burner according to the invention;

FIG. 57 is the section through LVII—LVII in FIG. 56;

FIG. 58 shows the burner of FIG. 56 from above.

Figure 2:
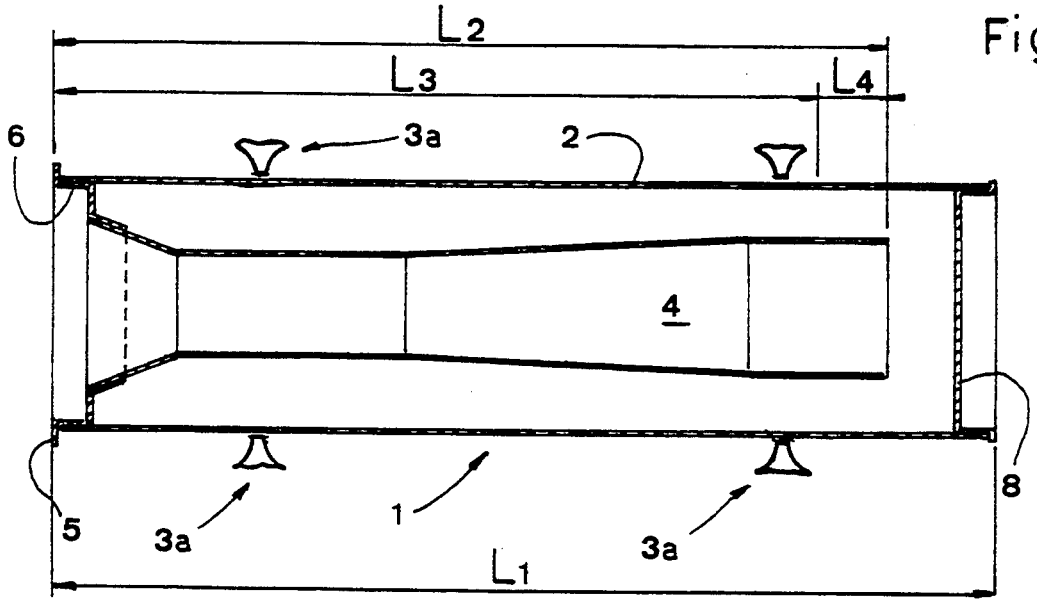
FIG. 2 is the longitudinal and vertical section through II—II in FIG. 1.
Figure 1:
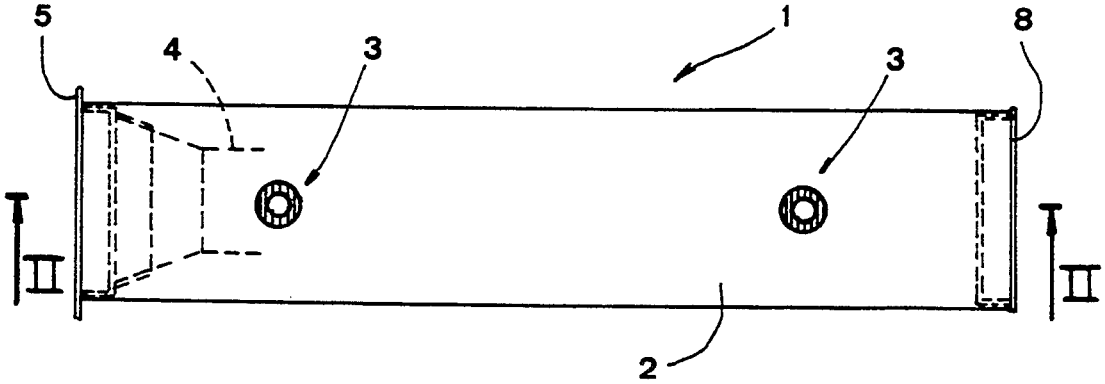
FIG. 1 is the view from above of a tubular burner according to the invention, for installation in an appliance with forced circulation of combusted air and gas, disposed with axis horizontal and with groups of slots distributed over the entire surface of the diffuser.
Figure 3:
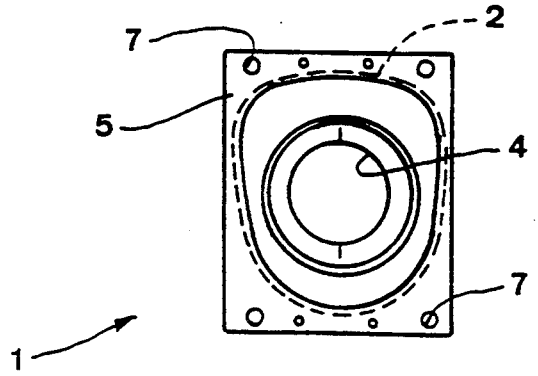
FIG. 3 shows the burner of FIG. 2 from the left, viewed along the longitudinal axis.
Figure 5:
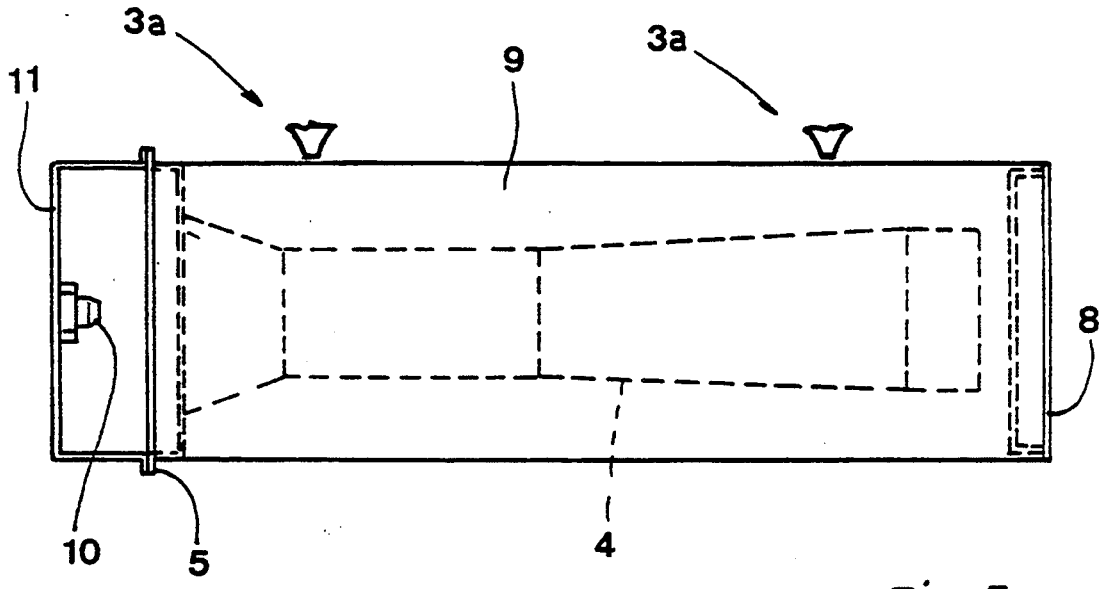
FIG. 5 is the side elevation of FIG. 4.

With reference to the drawings, 1 denotes a burner of tubular embodiment, comprising a diffuser 2 of which the entire operating surface is occupied by groups of slots 3, arranged in a given formation; 3*a* denotes the trumpet shaped flame issuing from each group of slots. 4 denotes a Venturi tube accomodated within and coaxial with the diffuser 2 of which the inlet is connected to a front flange 5 embodied with a peripheral internal lip 6 matched to the profile of the inner wall of the diffuser 2.

7 denotes one of a set of holes (FIG. 7) passing axially through the frontal surface of the flange 5 externally of the diffuser, by way of which to bolt the burner 1 to a gas manifold (not illustrated).

8 denotes a rear cover inserted into the end of the diffuser 2 positioned farthest from the flange 5.

L1 denotes the length of the diffuser 2, which is between 10 cm and 1 meter or over, depending upon the length of the combustion chamber in which the burner is to be installed; L2 denotes the length of the Venturi tube, including the connection to the front section of the diffuser, which to advantage is equal to L1 less a quantity such that the mean velocity of the mixture in reverse flow will not exceed 2 m/s, to which end the tube may be fitted with suitable inversion baffles (not illustrated); L3 is the distance between the diffuser inlet and the farthest extremity of the farthest group of slots, and L4 the difference between L2 and L3, which to advantage is between 50 and 150% of the diameter of the outlet section of the Venturi tube.

Figure 4:
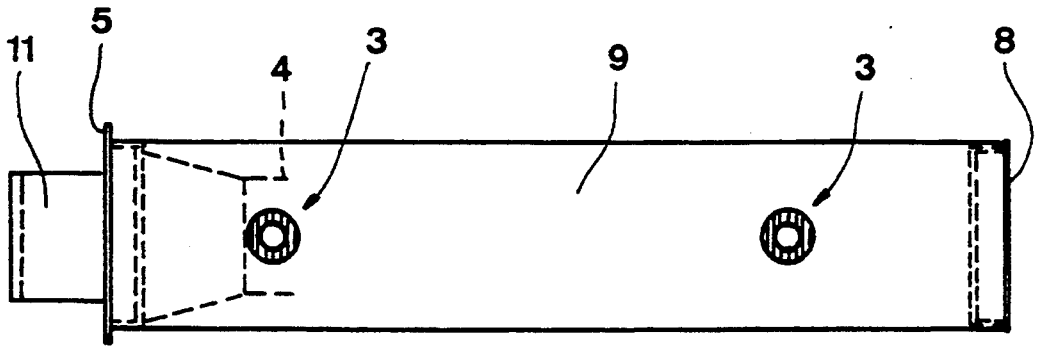
FIG. 4 is the view from above of a tubular burner for installation in an appliance with natural circulation of combusted air and gas, and with groups of slots distributed over the top part of the topmost surface of the diffuser.
Figure 6:
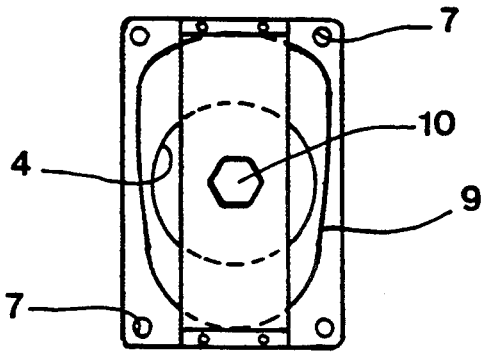
FIG. 6 shows the burner of FIG. 4 from the left, viewed along the longitudinal axis.

9 denotes a tubular diffuser (FIG. 4) with groups of slots 3 distributed over the topmost part of the lateral surface; 10 denotes a nozzle mounted to a bracket 11 secured forward of the flange 5, from which the mixture of air and combustible gas is ejected.

12 denotes a burner (FIG. 7) comprising a vertically disposed tubular diffuser 12*a* of cylindrical shape, and an inlet and mixer duct 13, which might be a Venturi tube, located externally of and normal to the axis of the diffuser 12*a* and connected into the lower part of the diffuser side wall; 14 denotes a nozzle bracket rigidly associated with the top of the inlet and mixer duct 13 at the forward end, and affording a through hole 15 coaxial with the duct; the diffuser 12*a* is enclosed by end covers 16 and exhibits groups of slots 3 ordered in successive bands around the uppermost part of the side wall.

Figure 9:
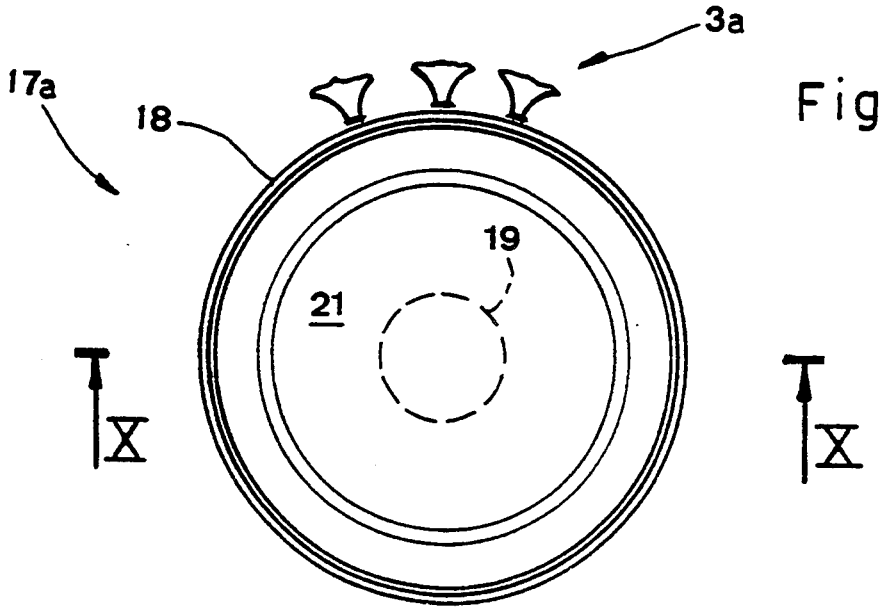
FIG. 9 is the view from above of a burner with a vertically disposed tubular cylindrical diffuser according to the invention, similar to that shown in FIG. 7 but with the external Venturi tube located beneath and coaxial with the diffuser, and with groups of slots distributed over the lateral surface of the diffuser.
Figure 10C:
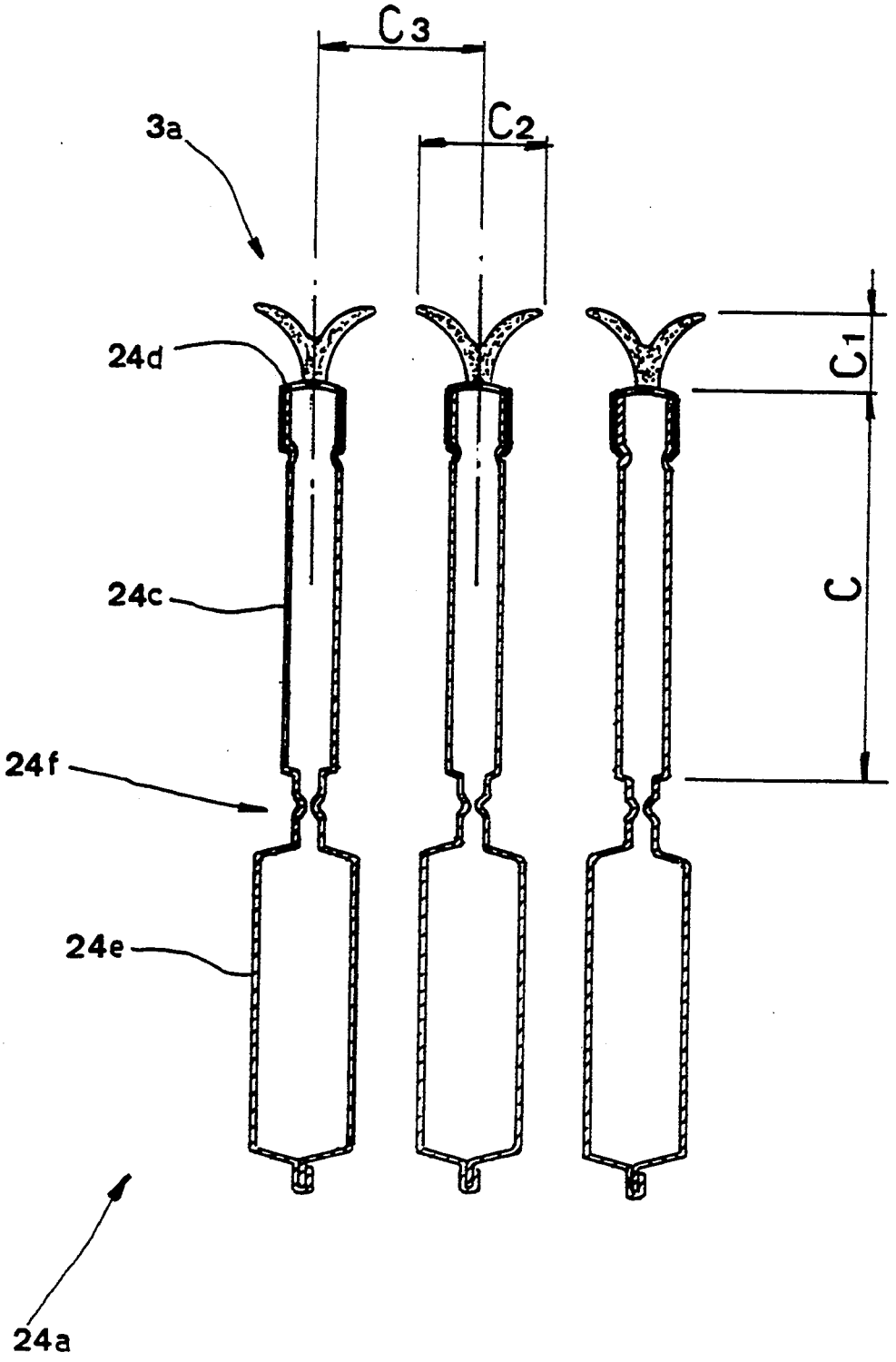
FIG. 10*c* is an intermediate vertical cross section through three elements constituting a burner as in FIG. 10*a;*

17*a* denotes a burner (FIG. 9) comprising a tubular diffuser 18 of cylindrical embodiment disposed with axis vertical, and an externally located inlet and mixer duct 19 disposed coaxial with the diffuser 18 and connected centrally to the bottom end cover 20; 21 denotes a similar top end cover, and 22 a flange insertable into the end of the tube 19 farthest from the diffuser and carrying a nozzle bracket 23 with the usual axial hole; 24 denotes a formation of groups of slots 3 ordered in successive bands and occupying the entire available height of the diffuser side wall, with the axes of the single normal to the axis of the diffuser 18.

Figure 10:
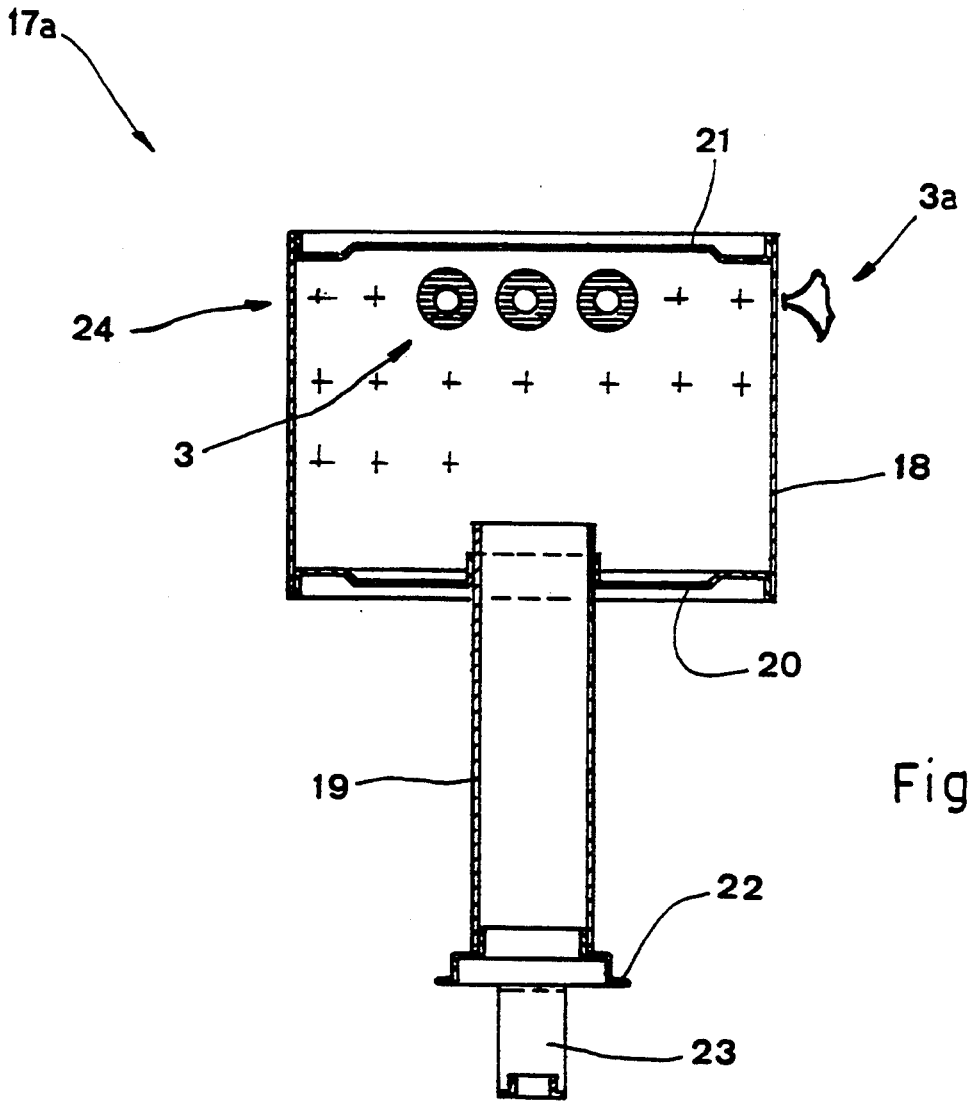
FIG. 10 is a longitudinal and vertical section through X—X in FIG. 9.

24*a* denotes a slimline burner (FIG. 10*a*) designed for assembly with others in banked formation, which comprises a Venturi type inlet duct 24*b* having a bent axis and emerging uppermost into a mixing and distribution chamber 24c of vertically elongated and parallelepiped embodiment, surmounted in turn by a diffuser 24d of rounded or cuspidate profile; 24e denotes the part of the duct 24b connecting the rear end of the Venturi with the chamber 24c above, and 24f a series of punched indentations extending longitudinally above the connecting duct 24e and serving to reduce the velocity of the air and gas mixture at the rear end of the burner element 24a.

C denotes the combined height of the distribution chamber 24c and the diffuser 18; C1 is the height of the flame, effectively 10 . . . 15 mm or thereabouts in the case of natural gas, which is propagated with little or no halo, thus liberating a potential heat of 2 kW approx per element 24a of the burner; C2 is the corresponding width of the single flame, which for a diffuser 24d measuring 8 mm approx in width will be 13 . . . 20 mm; C3 denotes the distance between centres of adjacent elements 24a, typically 18 . . . 25 mm; Z denotes the gas manifold, Z1 one of a plurality of nozzles disposed transversely to the manifold and in coaxial alignment with the inlet to the relative Venturi duct 24b, and Z2 a bracket supporting the element 24a, which is secured in its turn to a support Z3 located between the manifold and the Venturi inlet.

Figure 11:
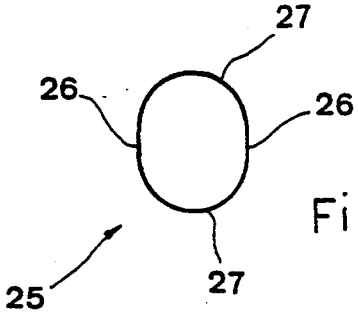
FIGS. 11, 12, 13, 14, 15, 16, 17, 18 are profiles of the right cross sections of diffusers as in the burners of FIGS. 1, 2, 3, 4, 5 and 6, which exhibit a closed loop convex curvilinear outline.

FIG. 11 shows the cross sectional profile 25 of a tubular diffuser as in the burner denoted 1, which is composed of parallel rectilinear stretches 26 interconnected at the top and bottom by tangential arcs 27; the groups of slots might be distributed over the topmost surface of such a diffuser or over the uppermost part of the lateral surface.

Figure 12:
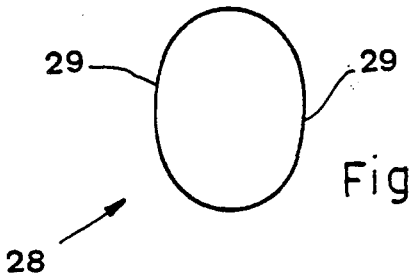

FIG. 12 shows a similar profile 28 which comprises convex curvilinear stretches 29 interconnected in like manner.

Figure 13:
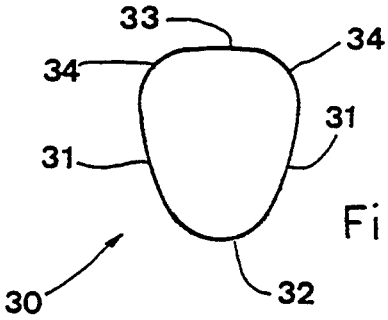
Figure 14:
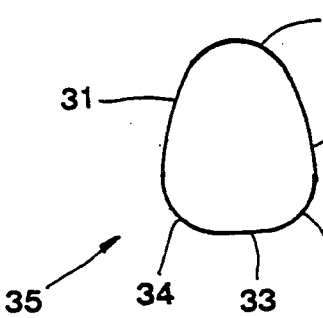

FIG. 13 shows the cross sectional profile 30 of a diffuser that comprises curvilinear lateral stretches 31 converging downward and interconnected by a bottom arc 32, and with the top ends united by a substantially straight central stretch 33 and two respective circumferential arcs 34;

FIG. 14 shows a profile 35 identical to that of FIG. 13 but with the vertical axis rotated through 180°. In like manner, any one of the profiles about to be described could be upturned.

Figure 15:
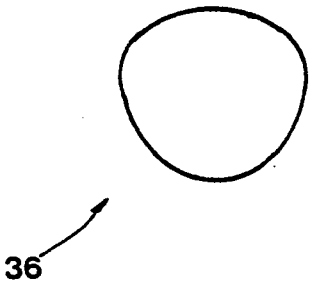
Figure 16:
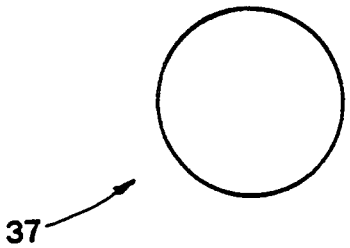
Figure 17:
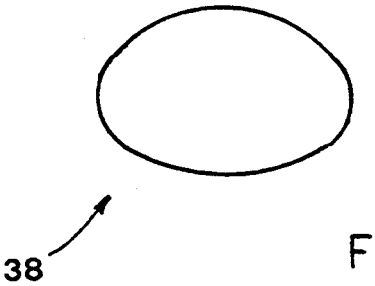
Figure 18:
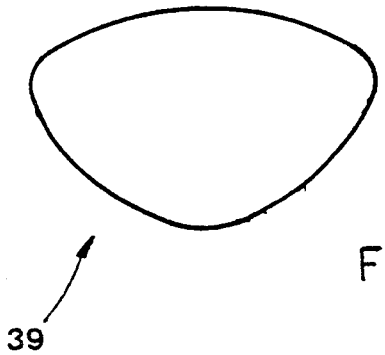
Figure 19:
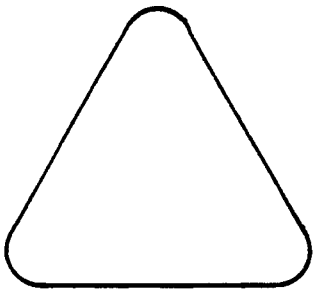
FIGS. 19, 20, 21, 22, 23, 24 are profiles of the right cross sections of diffusers as in the burners of FIGS. 1, 2, 3, 4, 5 and 6, which exhibit a closed loop polygonal outline with radiused vertices, for example triangular, quadrangular, penta-, hexa- and octagonal.
Figure 20:
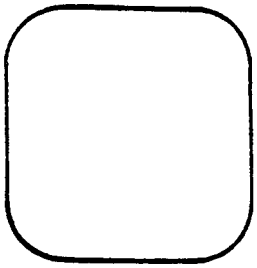
Figure 21:
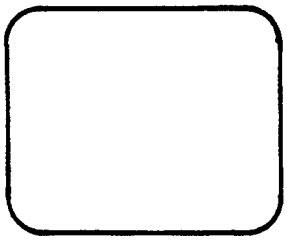
Figure 22:
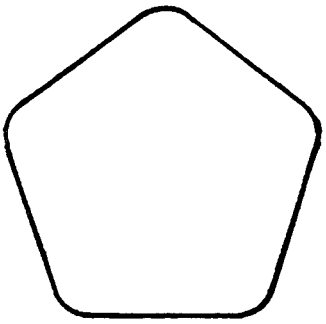
Figure 23:
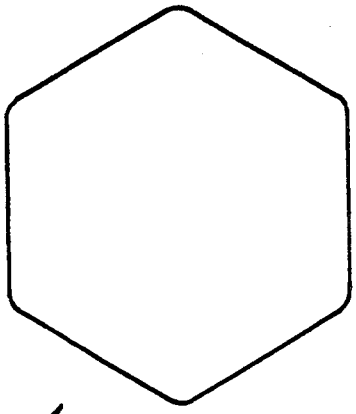
Figure 24:
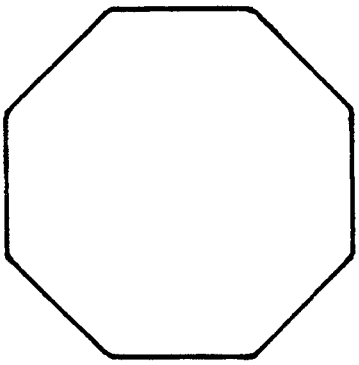

FIG. 15 shows a profile 36 similar to that of FIG. 13 but with sides exhibiting a shorter radius of curvature;

FIG. 16 shows the circular cross sectional profile 37 of a tubular diffuser;

FIG. 17 shows an asymmetrically elliptical cross sectional profile 38 with a top curve of shorter radius than the corresponding bottom curve;

FIG. 18 shows the profile 39 of a diffuser that appears triangular in section with curvilinear sides and rounded angles, and the vertex downwardly directed;

FIG. 19 shows a further triangular profile 40 with straight sides, rounded angles and the vertex upwardly directed;

FIG. 20 shows the profile 41 of a diffuser that appears in section as a square with rounded corners;

FIG. 21 shows a profile 42 similar to that of the preceding figure, in this instance rectangular;

FIG. 22 shows the profile of a diffuser appearing in section as a pentagon with rounded angles;

FIGS. 23 and 24 are cross sections 44 and 45 of hexagonal and octagonal profile, respectively. 46 denotes a group of fourteen slots 46a (FIG. 25), each slot appearing as an elongated rectangle with rounded ends, disposed with axes parallel and lying transverse or parallel to the axis of the diffuser, or even angled in relation to the diffuser axis, advantageously at approximately 45°; the slots are arranged in nine rows, all encompassed within an octagonal profile, of which the five innermost comprise two slots aligned on either side of and tangentially to an unpierced rhomboidal central zone Ac measuring 5 . . . 40 mm) in surface area and with one diagonal disposed parallel to the axes of the slots; Ap denotes the area of the surface lying between the octagonal and rhomboidal profiles, in practice between 3 and 10 times the value of the central area Ac; P is the pitch or distance between centres of the adjacent slots of one group, which may be constant or variable and might be equal to or greater than 1.25 mm, for example, the length of each slot being, to advantage, between 2 and 15 mm, and the width between 0.4 and 0.7 mm approx, when fashioned in sheet metals of 0.4 to 0.65 mm gauge.

Figure 25:
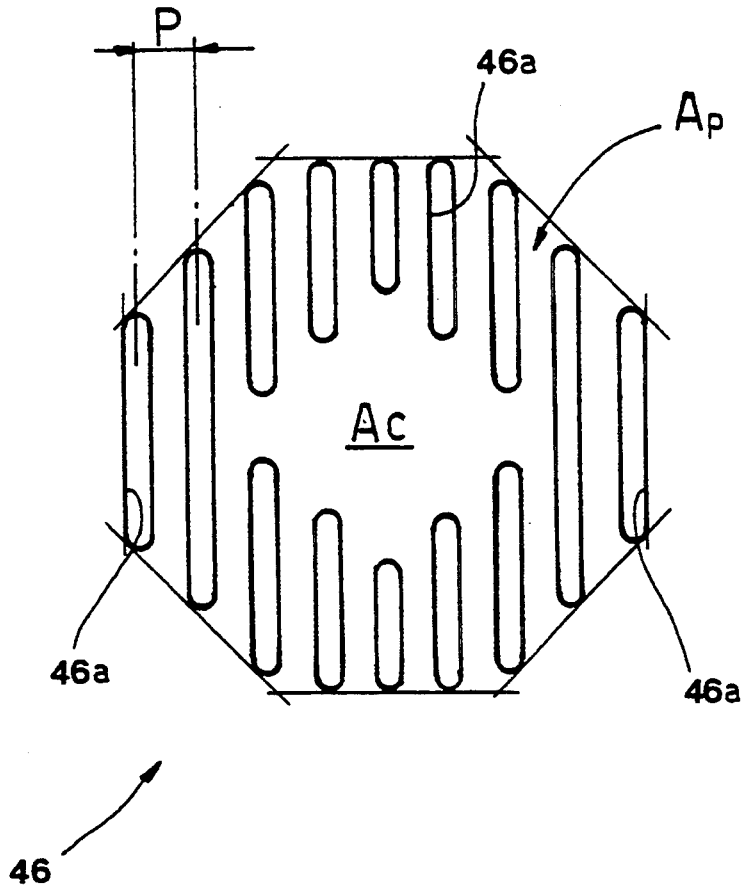
FIG. 25 illustrates one of the groups of slots of a diffuser according to the invention, enlarged and in detail and developed, of which the slots are disposed with their longitudinal axes mutually parallel and occupy a peripheral zone defined internally by a rhombus, constituting the central zone of the group, and encompassed externally by an octagon.
Figure 26:
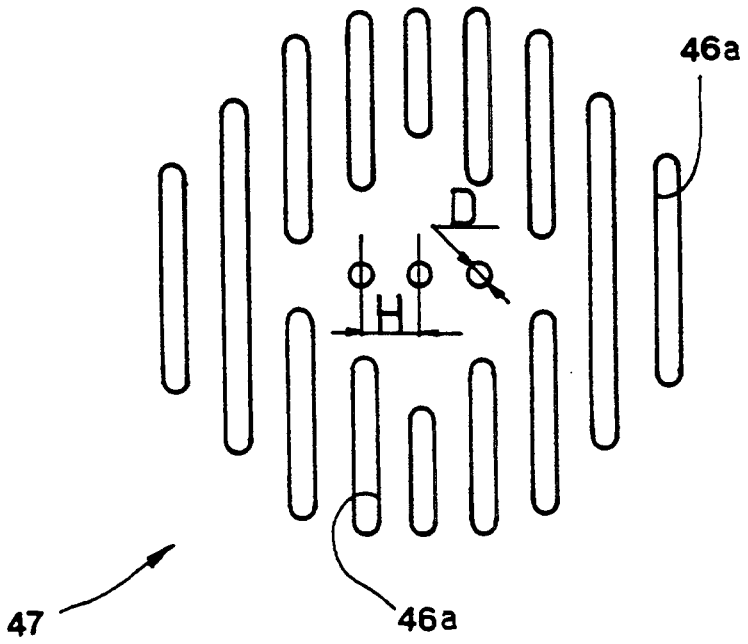
FIG. 26 is the enlarged and detailed illustration of a group of diffuser slots as in FIG. 25, in this instance with the central zone occupied by three longitudinally aligned holes serving to stabilize the flame.

47 denotes a group of slots 46a identical to those of FIG. 25, in combination with additional central holes of diameter D between 0.6 mm and 1 mm approx, of which the purpose is to stabilize the flame; the central holes are disposed, advantageously, along one of the diagonals of the rhomboidal central zone and might be three in number, preferably, or indeed any number from 1 to 5, with a preferred distance H between centres of 1.4 mm approx.

Figure 27:
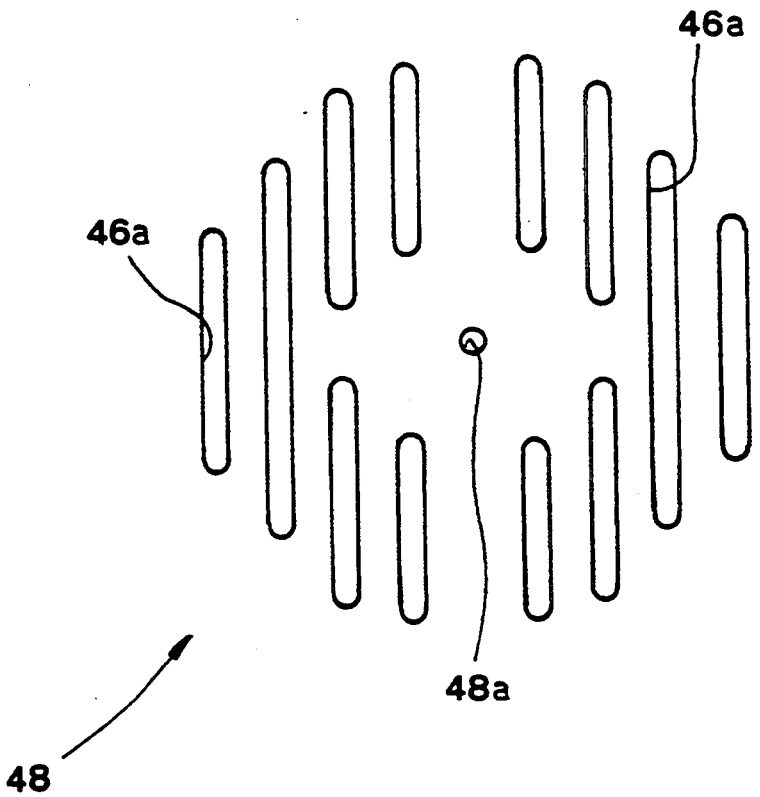
FIG. 27 is the enlarged and detailed illustration of a group of diffuser slots as in FIG. 25, in this instance with a single hole in the central zone serving to stabilize the flame and with the two central slots eliminated.
Figure 28:
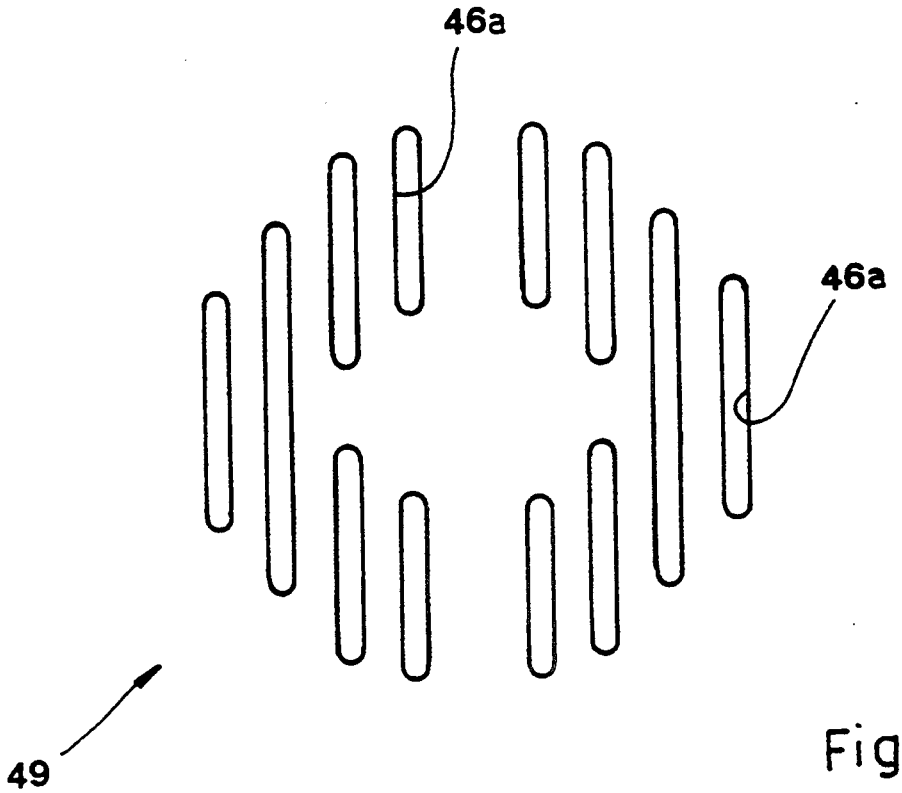
FIG. 28 is the enlarged and detailed illustration of a group of slots as in FIG. 27, though without holes in the central zone for stabilization of the flame.

48 denotes a group of slots (FIG. 27) similar to that of FIG. 25, but in combination with a central hole 48a for stabilization of the flame and without the middle pair of slots; 49 denotes a group of slots (FIG. 28) identical to that of FIG. 27, but without the central hole for stabilization of the flame.

50 denotes a group of fourteen slots 46a (FIG. 29) disposed with axes parallel and lying transverse or parallel to the axis of the diffuser or even angled in relation to the diffuser axis, advantageously, at 45°, each single slot appearing as an elongated rectangle with rounded ends; the slots are disposed tangential to one or both concentric circumferences of an annular peripheral zone; R1 is the radius of the inner circle of the annulus, measuring less than or equal to 3.5 mm approx., R2 is the radius of the outer circle, equal to or greater than 8 mm, whilst the width and the distance between centres of the slots are as described in respect of FIG. 25; 51 denotes the central stabilizing hole, which is of diameter D1 between 0.6 mm and 1 mm approx.

Figure 29:
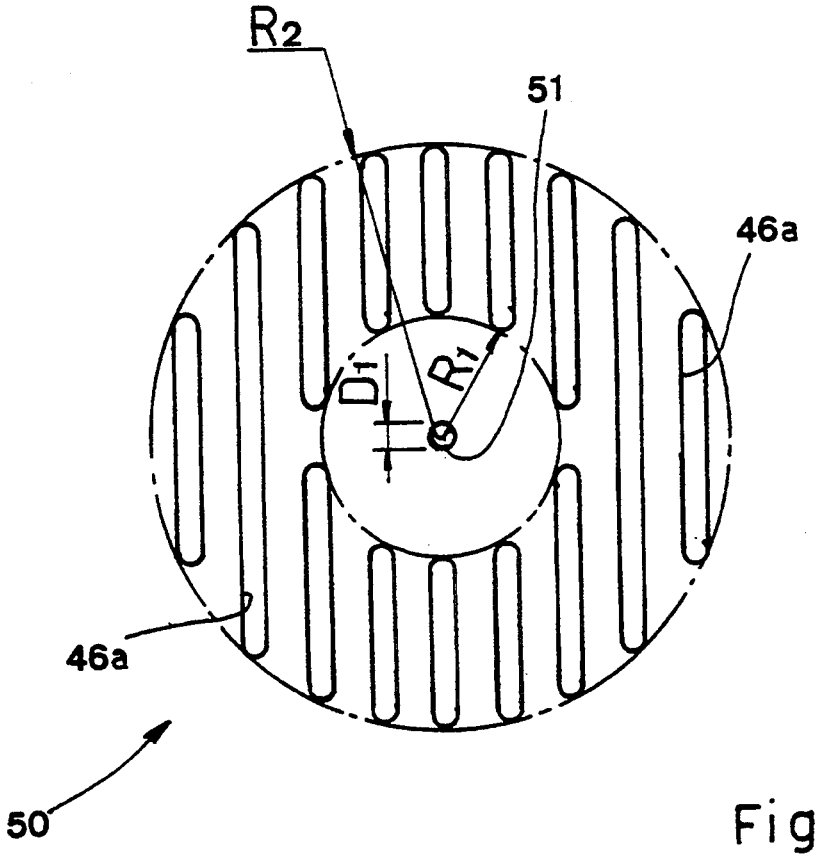
FIG. 29 is the enlarged and detailed illustration of a group of slots of a diffuser according to the invention, showing slots disposed with longitudinal axes mutually parallel and occupying a peripheral zone in the form of an annulus, and a central hole for stabilization of the flame.
Figure 30:
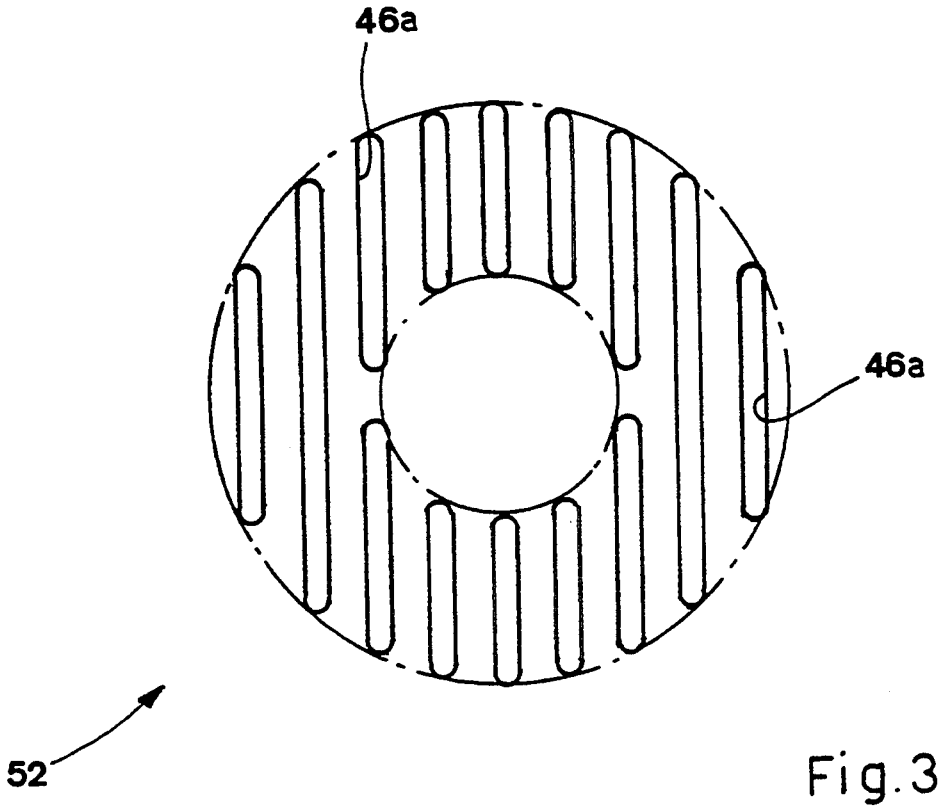
FIG. 30 is the enlarged and detailed illustration of a group of slots as in FIG. 29, though without central holes for stabilization of the flame.

52 denotes a group of slots (FIG. 30) identical to that of FIG. 29, though without the central hole for stabilization of the flame.

53 denotes a group of twelve slots (FIG. 31) either transversely or longitudinally disposed in relation to the axis of the diffuser, or angled in relation thereto advantageously at 45° or thereabouts, and lying externally tangential to an oval F of which the greater axis is disposed normal to the axes of the slots; G and G1 denote centres symmetrically located on either side of the greater axis of the oval F, from which radii R3 and R4 of identical length describe two relative arcs, two further arcs being described from respective centres N and N1 located symmetrically on either side of the lesser axis of the oval, with equal radii r and r1: the radii R3 and R4 are equal to or greater than 5 mm, and the radii r and r1 equal to half the radii R3 and R4 or thereabouts.

F1 denotes an internal oval tengential to the inner ends of the slots of the group, and substantially homothetic in relation to the outer oval F; the dimensions and the distance between centres of the slots could be the same, for example, as those of the group of slots 46 shown in FIG. 25 and described above; 54 denotes a central hole for stabilization of the flame, of diameter between 0.6 mm and 1 mm or thereabouts.

Figure 31:
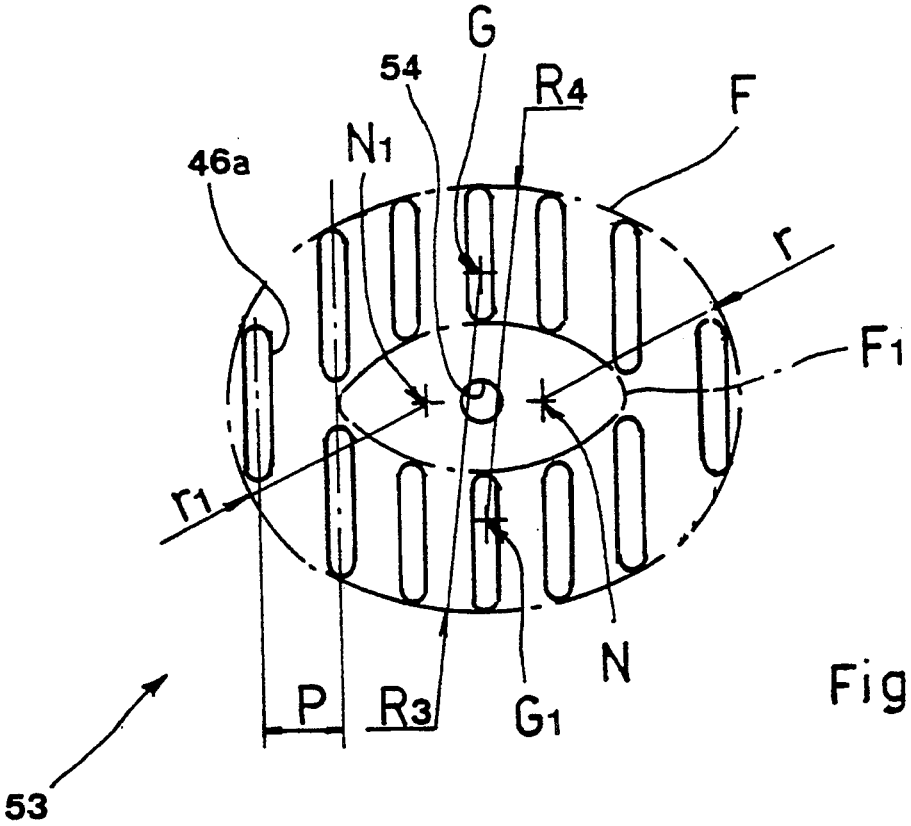
FIG. 31 is the enlarged and detailed illustration of a group of slots of a diffuser according to the invention, showing slots arranged in a peripheral zone encompassed between two practically homothetic ovals, and a central hole for stabilization of the flame.
Figure 32:
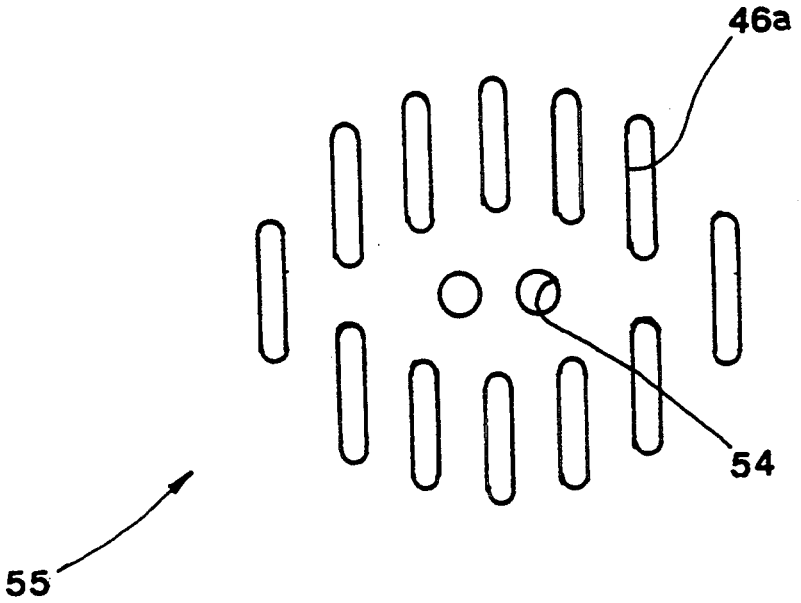
FIG. 32 is the enlarged and detailed illustration of a group of slots as in FIG. 31, though with two holes in the central zone for stabilization of the flame.
Figure 33:
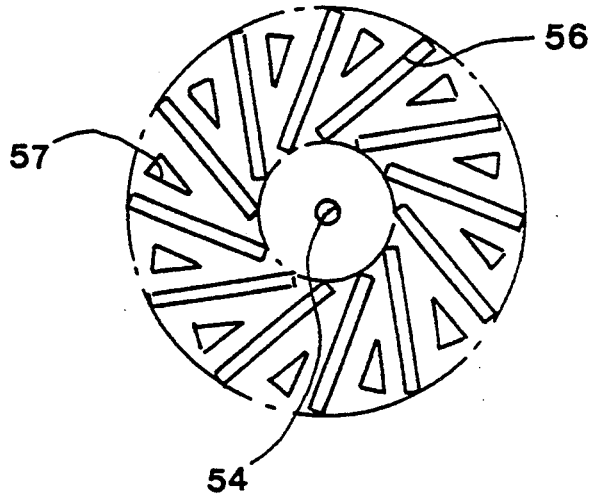
FIG. 33 is the enlarged and detailed illustration of a group of slots occupying an annular peripheral zone, angled singly between directions radial and tangential to the circular central zone of smaller radius, and intercalated with triangular openings.
Figure 34:
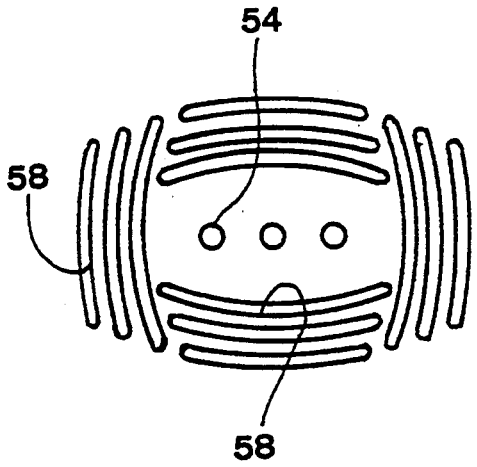
FIG. 34 is the enlarged and detailed illustration of a group of slots exhibiting a curved profile and occupying a peripheral zone encompassed between two concentric rectangles with curvilinear sides.
Figure 35:
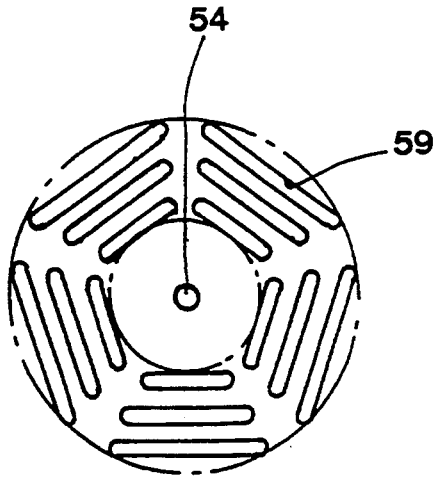
FIG. 35 is the enlarged and detailed illustration of a group of slots occupying an annular peripheral zone, distributed transversely and coinciding with the sides of a plurality of concentric pentagons inscribed within the annulus.
Figure 36:
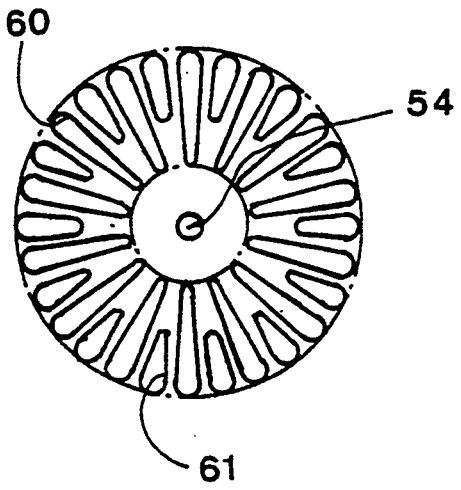
FIG. 36 is the enlarged and detailed illustration of a group of slots arranged in two radiating sets of dissimilar dimensions internally of an annular peripheral zone.
Figure 37:
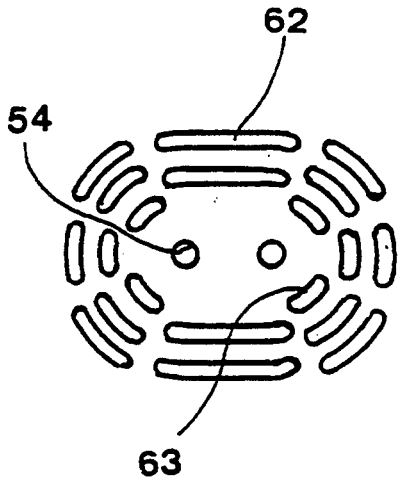
FIG. 37 is the enlarged and detailed illustration of a group of slots arranged in oval tiers of increasing developable length.
Figure 38:
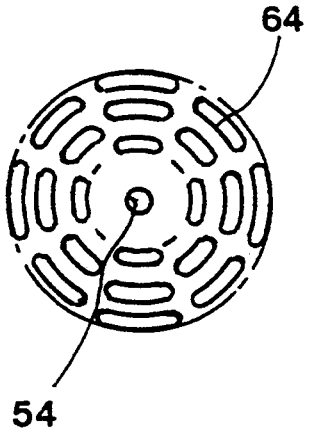
FIG. 38 is the enlarged and detailed illustration of a group of arcuate slots occupying concentric circumferences.
Figure 40:
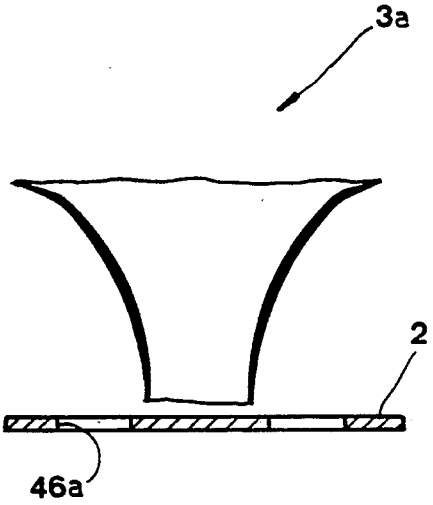
FIG. 40 is a central vertical section through XL—XL in FIG. 39.
Figure 41:
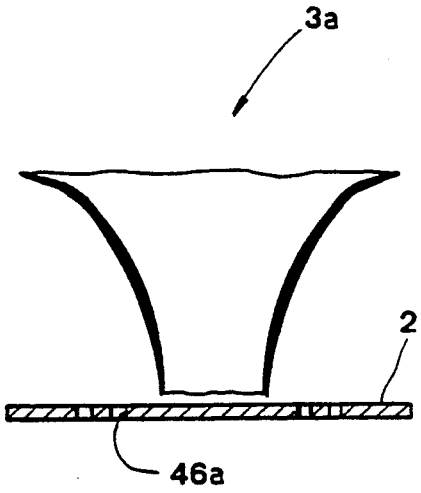
FIG. 41 is the central vertical section through XLI—XLI in FIG. 39, disposed perpendicular to that of FIG. 40.
Figure 39:
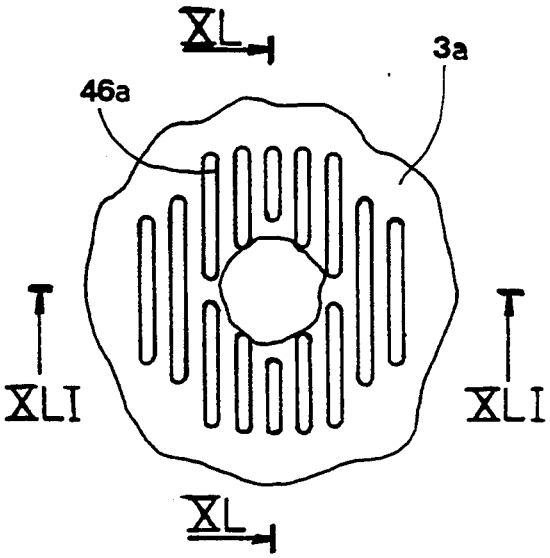
FIG. 39 is the view from above of a flame appearing trumpet or funnel shaped.
Figure 42:
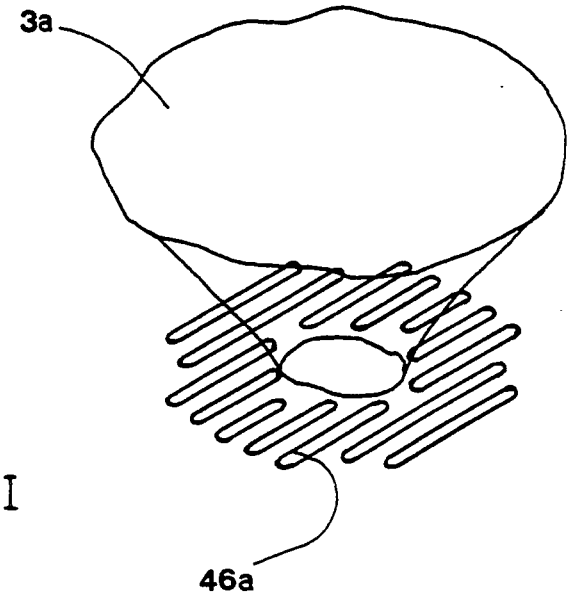
FIG. 42 is a view in perspective of the flame propagated from a group of slots as in FIGS. 39, 40 and 41.

55 denotes a group of slots (FIG. 32) similar to that shown in FIG. 31, but in conjunction with two holes 54 for stabilization of the flame; 56 denotes one of a group of skew elongated rectangular slots (FIG. 33), 57 one of a group of triangular slots, 58 one of a group of elongated arcuate slots (FIG. 34), and 59 one of a group of slots coinciding with the sides of a pentagon (FIG. 33); 60 and 61 denote dissimilar groups of radial slots (FIG. 36) ordered in two sets, 62 and 63 groups of slots (FIG. 37) ordered in radiating tiers, and 64 denotes a group of slots (FIG. 38) coinciding with concentric circles.

Figure 43:
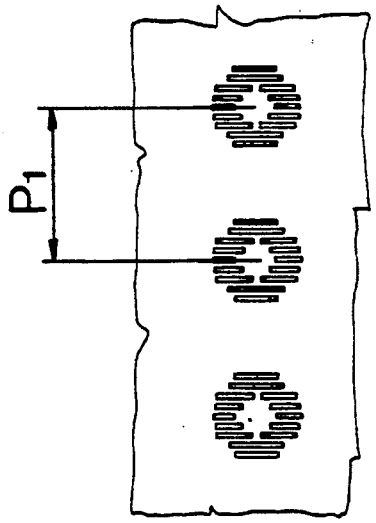
FIG. 43 is the view from above of an enlarged part of the topmost surface of the diffuser of a burner according to the invention, in which the groups of slots are aligned, at regular pitch, parallel with the axis of the burner.
Figure 44:
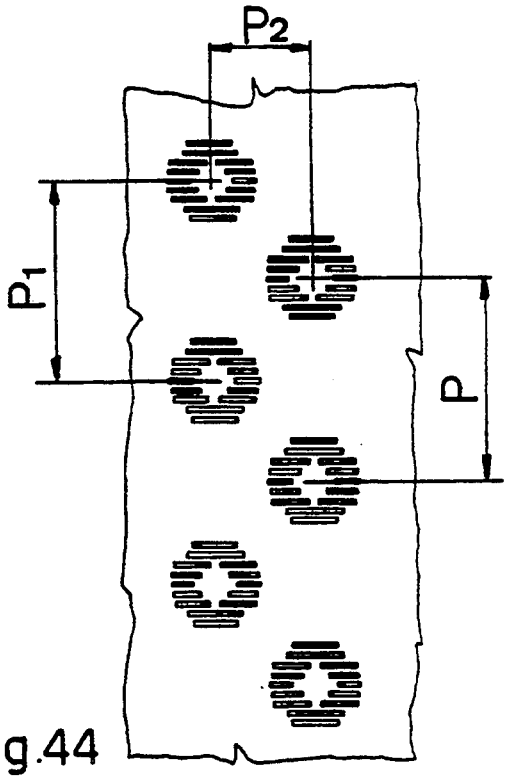
Figure 46:
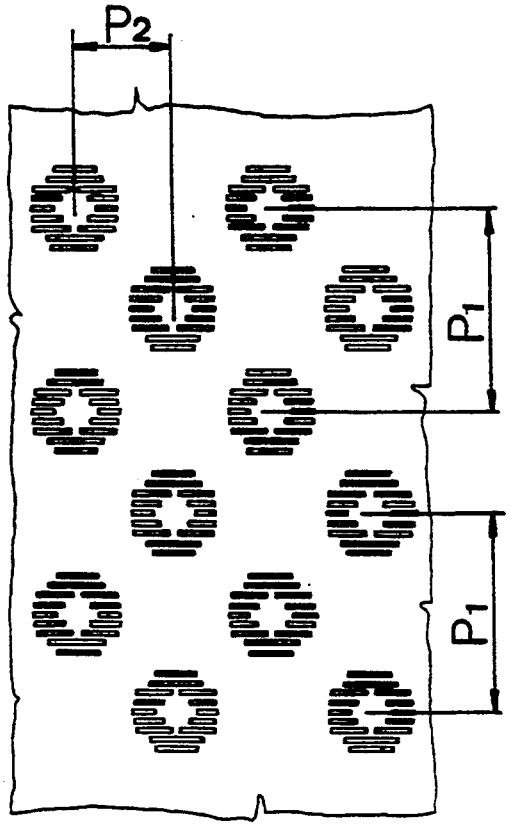
Figure 45:
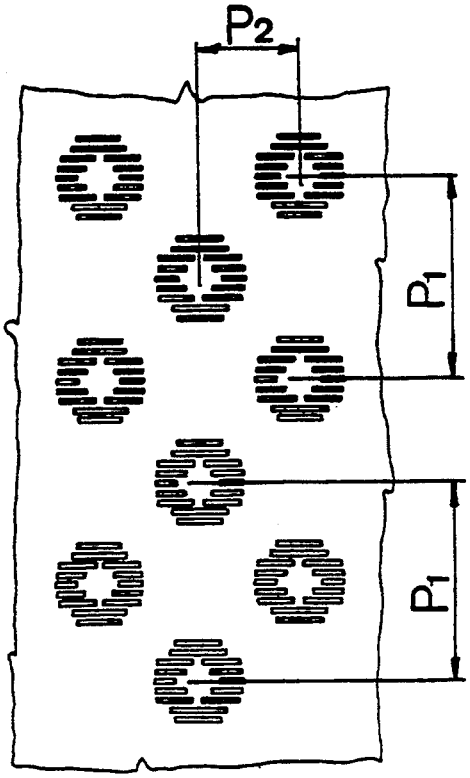

In FIG. 43, P1 denotes the longitudinal pitch or distance between centres of groups of slots, which might be constant or variable from group to group, whilst P2 in FIG. 44 is the transvere pitch between groups of slots, which likewise might be variable from group to group; moreover, the groups of slots shown in FIGS. 43 to 50 might be replaced with any of the types of group illustrated in FIGS. 25 to 42.

65 denotes a formation of groups of slots (FIG. 50) of which the centres coincide with the corners and intermediately with each side of a square measuring length M per side, the groups at the corners being disposed with the longitudinal axes of the slots angled, advantageously, at 45° to the axis of the diffuser; P3 denotes the pitch at the which the formations of the groups of slots are distributed. 66 denotes a square (FIG. 51) constituting the lesser base of a frustopyramidal diffuser, and 67 the relative trapezoidal faces; 68 denotes the top isosceles triangular face (FIG. 52) exhibited by a diffuser of three-sided prismatic embodiment, of which the squarer face of the form is denoted 69 and the two rectangular faces are denoted 70.

71 denotes a circle (FIG. 53) constituting the lesser base of a frustoconical diffuser, and 72 the developed conical surface.

Figure 54:
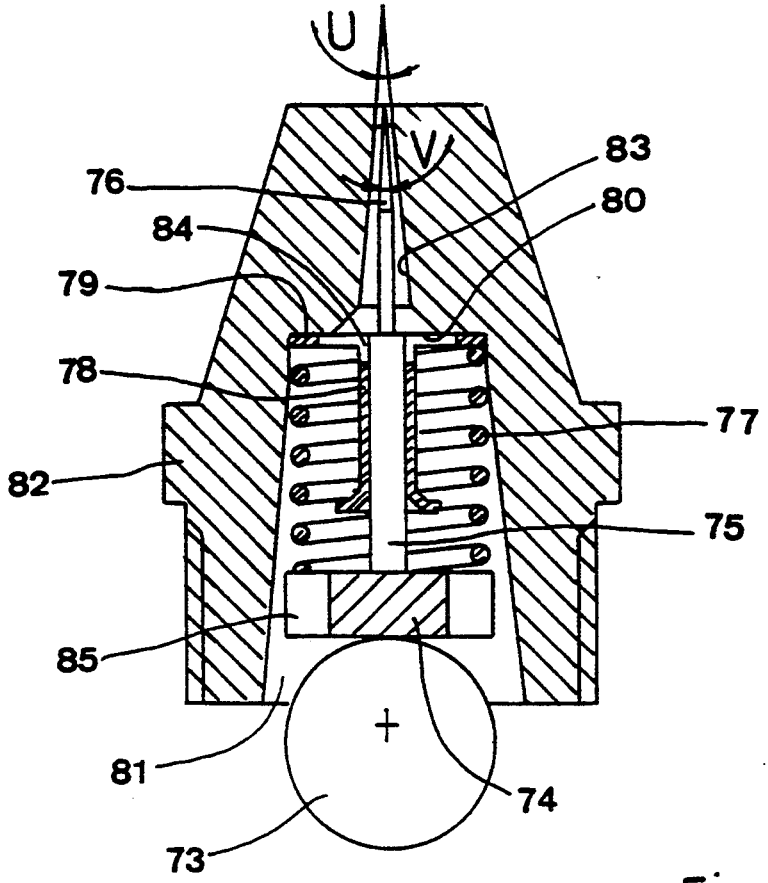
FIG. 54 is a longitudinal section through the variable outlet fuel nozzle according to the invention.

FIG. 54 illustrates a nozzle assembly comprising a cam 73 impinging on the end plate 74 of the stem 75 of a proportioning valve element 76 exhibiting a conical profile; 77 denotes a cylindrical coil spring encircling a sleeve 78 slidably ensheathing the stem 75, by which the plate 74 is biased into engagement with the cam 73, and 79 the head of the sleeve which is breasted frontally with the end surface 80 of a coaxial chamber 81 formed in the rear part of a relative valve housing 82 of which the frustoconical orifice 83 is disposed coaxial with the stem. U denotes the angle between the generators of the frustoconical orifice 83, which may be as much as 10° or more, and V denotes the angle between the generators of the conical end of the stem 75, which will approximate to the angle U.

Figure 55:
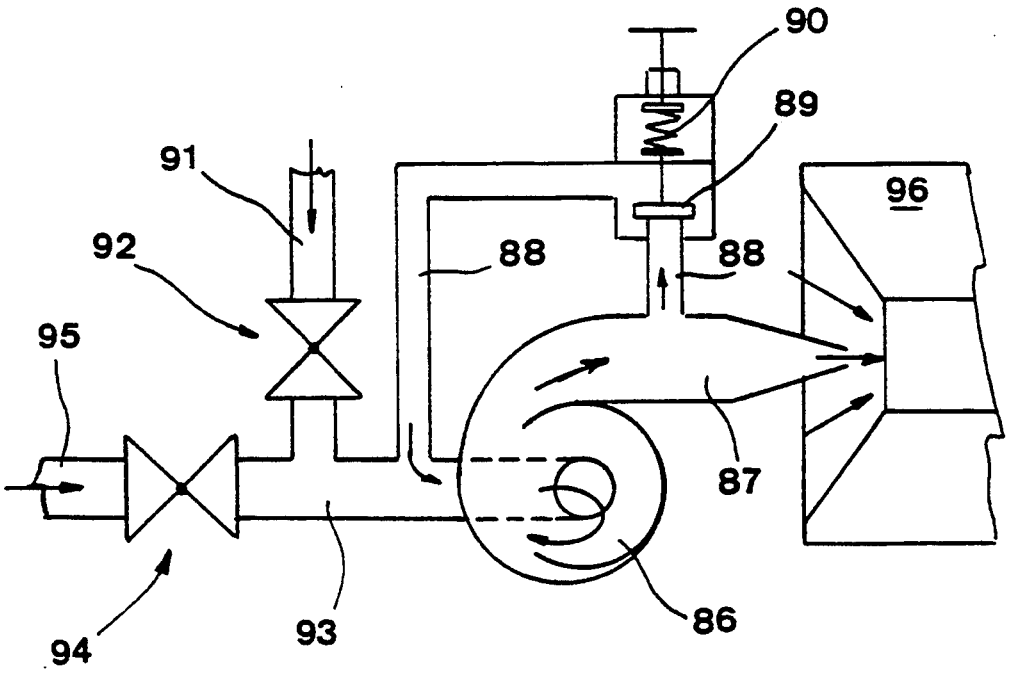
FIG. 55 is the diagram of a system according to the invention for the mixture and forced feed of fuel and air.

84 denotes a plurality of radial slots set in the forward end of the sleeve 78, and 85 a plurality of notches in the body of the plate 74, both of which serve to allow the passage of fluid to the orfice. 86 denotes a compressor (FIG. 55) of which the outlet is branched into a recirculation duct 88 controlled by a valve element 89 biased toward the closed position by a spring 90, and into which air is directed from a pipeline 91 controlled by a first on-off valve 92 and connected with the inlet, denoted 93, into which gas is also directed by way of a relative valve 94 from a further pipeline 95; 96 denotes the body of the relative burner.

97 denotes the diffuser (FIG. 56) of a burner of which the cross section exhibits a pair of lateral lobes 98 (FIG. 57) flanking the inlet ports 99 to the burner longitudinally, and 100 a longitudinal baffle that exhibits an upturned minuscule omega profile when viewed in section and serves to create mixing ducts with sinuous symmetrical axes.

The diffuser 97 is enclosed by covers 101 at each end. As regards the method disclosed, which can be implemented adopting two levels of premixture, with a rate of aeration equal to or less than 1.1 or continuously greater than 1.1, respectively, it will be observed that to obtain the one condition rather than the other depends not least on the manner in which the burner is installed in the relative appliance, and especially on temperature, and on the height of the column of gas and the aerodynamic resistances offered by the circuit carrying post-combustion air and gases; the two levels therefore are not dependent solely upon the combustion type and construction specifications of the burner and the system.

DESCRIPTION OF THE PREFERRED EMBODIMENTS

The following examples illustrate methods of planning the computation of specifications for burners in implementation of the method, designed for operation at the two levels in question.

EXAMPLE 1

Tubular burner for an appliance operating with natural circulation of combusted air and gas, and with any given rate of aeration:

a1) Section of burner body with aspect ratio (height to width) advantageously greater than 1.5, to give mean velocity of the mixture no greater than 2 m/s through the annular section between Venturi tube and diffuser.

b1) Venturi tube allowing mean velocity of mixture through the throat equal to or less than 4 m/s; length of Venturi tube exceeding the pierced surface of the diffuser at least by a quantity equal to 50 . . . 150% of outlet section; distance between outlet section of Venturi and end wall of diffuser such that velocity of the mixture at inversion is on average greater than 2 m/s.

c1) Groups of slots distributed at least over the topmost surface of a diffuser with horizontal axis, and occupying a total area such as to determine a specific loading on the diffuser of less than 0.7 $kW/cm^2$; the single slots arranged around and extending transversely or tangential to a central zone, intercalated with smaller complementary holes or otherwise, and circular, rectangular, triangular, trapezoidal in shape or of other non geometrical shape; the central zone pierced with holes or otherwise, all according to the invention.

d1) Distribution of the groups of slots in ranks (transverse to the diffuser axis) set apart one from the next by a distance at least equal to 65% of the maximum transverse dimension of the group, with an axial distance between the groups of two successive files equal at least to nd/2, where d is the axial dimension of one group and n is the number of groups in one rank, or in two successive ranks in a chequered pattern;

e1) Fuel feed nozzles of variable outlet section, according to the invention.

EXAMPLE 2

Tubular burner for an appliance operating with forced circulation of combusted air and gas, and with a rate of aeration greater than 1.1:

a2) Section of burner body with diffuser of tubular, circular, polygonal or any other profile.

b2) Mixer device of embodiment alternative to Venturi tube.

c2) Groups of slots distributed over the entire surface of the diffuser.

d2) Arrangement of the groups of slots in ranks with groups separated one from the next by a distance at least equal to 65% of the maximum dimension of the group as measured along the direction of separation.

e2) Nozzle outlet pressures between 100 and 450 mbar at maximum output, according to the pressure rise overcome in effecting the circulation of post-combustion gases (given, surprisingly, that the value of the aeration rate remains constant with the diminishing pressure value), maintained advantageously through the use of a variable speed centrifugal compressor of which the outlet is branched to recirculate part of the delivery flow and the inlet is connected to on-off valves by which the gas and air supplies are controlled and alternated to ensure a smooth transition from ignition to steady burn by flooding the combustion chamber initially with air.

EXAMPLE 3

Burner embodied in matching halves for installation preferably in banked elements, in appliances with natural or forced circulation of post-combustion gases and with any given rate of aeration.

a3) Essentially tall mixing and distribution element of elongated rectangular cross section, inserted between the outlet section of a curvilinear axis Venturi tube and the diffuser.

b3) Groups of slots according to the invention, aligned longitudinally along the topmost surface of the diffuser, and set apart one from the next at a distance calculable simply as less than half the longitudinal dimension of the group.

EXAMPLE 4

Burner with horizontal axis tubular diffuser, and coaxially disposed internal Venturi tube.

| | |
|---|---|
| length of diffuser | 394.6 mm |
| length of Venturi tube | 339 mm |
| diameter of Venturi throat section | 26 mm |
| diameter of Venturi outlet section | 35 mm |
| distance between diffuser inlet and farthest group of slots | 324 mm |

GEOMETRY OF DIFFUSER

Cross section of profile appearing as a pair of opposed and upwardly convergent curvilinear lines interconnected uppermost by an arc and connected at bottom through further arcs to a curvilinear base (see FIG. 14):

| | |
|---|---|
| height of diffuser | 61.3 mm |
| width of diffuser | 51.5 mm |
| radius of curvature of each of the two opposite sides | 76 mm |
| radius of curvature of base | 45.5 mm |

-continued

| | |
|---|---|
| radius of top interconnecting arc | 23 mm |
| radius of arcs connecting sides and base | 13 mm |
| centres to the base and top arc coinciding with the vertical axis of symmetry of the diffuser; centres to the opposite sides coinciding with the horizontal axis on either side of the vertical axis of symmetry. | |

TOPOGRAPHY OF SLOTS IN EACH GROUP

| | |
|---|---|
| width of single slot | 0.5 mm |
| distance between centres of slots | 1.25 mm |
| number of slots | 14 |
| slots disposed with axes mutually parallel and within a peripheral zone bordering internally on a rhombus with greater and lesser diagonals 6.1 mm and 5.5 mm respectively and encompassed by a regular octagon with apothem 5.75 mm approx. | |

DISTRIBUTION OF GROUPS OF SLOTS

The groups are distributed along the top surface of the diffuser in four longitudinal files staggered one from the next by a distance of 13 mm, or a distance discernibly half the distance separating groups of the same file, and set apart transversely by a distance (pitch P2 in FIG. 46) of 13 mm, the distance separating groups of the same file (P1) being 26 mm.

EXAMPLE 5

Burner with horizontal axis tubular diffuser and coaxially disposed internal Venturi tube.

| | |
|---|---|
| length of diffuser | 325.6 mm |
| length of Venturi tube | 290 mm |
| diameter of Venturi throat section | 26 mm |
| diameter of Venturi outlet section | 33 mm |
| distance between diffuser inlet and farthest group of slots | 290.6 mm |

GEOMETRY OF DIFFUSER

Cross section of profile appearing as a pair of opposed and downwardly convergent curvilinear lines interconnected at bottom by an arc and connected through further arcs to a curvilinear top stretch (FIG. 13), of dimensions corresponding to those of Example 4 and obtained by rotation of the relative axis of symmetry through 180°.

TOPOGRAPHY OF SLOTS IN EACH GROUP as in Example 4.

DISTRIBUTION OF GROUPS OF SLOTS

The groups are distributed along the top surface of the diffuser in four longitudinal files staggered one from the next by a distance of 14.8 mm, or a distance discernibly half the distance separating groups of the same file, set apart at transverse pitch (P2) of 13 mm, and longitudinal pitch (P1) of 29.5 mm.

EXAMPLE 6

Burner with horizontal axis tubular diffuser and coaxially disposed internal Venturi tube.

| | |
|---|---|
| length of diffuser | 336.3 mm |
| length of Venturi tube | 302 mm |
| diameter of Venturi throat section | 30 mm |
| diameter of Venturi outlet section | 42 mm |
| distance between diffuser inlet and farthest group of slots | 294.5 mm |

GEOMETRY OF DIFFUSER

Cross section of profile appearing as a pair of opposed and downwardly convergent curvilinear lines interconnected at bottom by an arc and connected through further arcs to a curvilinear top stretch (FIG. 13):

| | |
|---|---|
| height of diffuser | 82.9 mm |
| width of diffuser | 54.5 mm |
| radius of curvature of each of the two opposite sides | 156 mm |
| radius of bottom interconnecting arc | 23.7 mm |
| radius of curvature of top stretch | 44.2 mm |
| radius of arcs connecting sides and top | 13 mm |
| centres to the top stretch and interconnecting bottom are coinciding with the vertical axis of symmetry of the diffuser; | |
| centres to the opposite sides situated at 13.5 mm from the horizontal axis on either side of the vertical axis of symmetry. | |

TOPOGRAPHY OF SLOTS IN EACH GROUP as in Example 4.

DISTRIBUTION OF GROUPS OF SLOTS

The groups are distributed along the top surface of the diffuser in four longitudinal files staggered one from the next by a distance of 13 mm, or by a distance discernibly half of that separating groups of the same file, set apart at a transverse pitch (P2) of 14 mm between the first and the second file and between the third and the fourth, and of 13 mm between the second and third, and at a longitudinal pitch (P1) of 26 mm.

EXAMPLE 7

Burner consisting in a bank of discrete slimline diffuser elements exhibiting elongated rectangular section, each liberating 2 kM approx, installed in an appliance with natural circulation of combusted air and gas:

length of slot approx 2 mm to approx 3 mm;
width of slot approx 0.5 mm to approx 0.7 mm;
pitch of slots equal to or greater than 1.3 mm;
diameter of central flame stabilizing holes approx 0.6 mm to approx 1 mm;
distance between centres of stabilizing holes approx 1.3 mm to approx 1.7 mm;
transverse pitch of slimline elements approx 18 mm to approx 25 mm;
pitch of groups of slots approx 12 mm to approx 17 mm;
greater radius of outer oval profile approx 5 mm to approx 15 mm;
lesser radius of outer oval profile approx 2.5 mm to approx 7.5 mm;
distance between the top surface of the diffuser and the bottom surface of the heat exchanger approx 80 mm to approx 160 mm;
height of distribution chamber between a few mm and 50 mm.

EXAMPLE 8

Burner consisting in a bank of discrete slimline diffuser elements exhibiting elongated rectangular section, for installation in an appliance with natural circulation of combusted air and gas:

| | |
|---|---|
| type of diffuser: sheet metal, marginally convex; | |
| width of diffuser | 8 mm |
| height of distribution chamber | 50 mm |
| number of slots per group on each of two sides | 5 |
| number of endmost slots per group | 2 |
| length of single slot | 2.5 mm |
| width of single slot | 0.65 mm |
| width of each group | 7.75 mm |
| length of each group (between axes of endmost slots) | 7.8 mm |
| pitch of slots | 1.3 mm |
| pitch of groups | 12.25 mm |

EXAMPLE 9

Burner consisting in a bank of discrete slimline diffuser elements exhibiting elongated rectangular section, for installation in an appliance with natural circulation of combusted air and gas:

| | |
|---|---|
| type of diffuser: sheet metal, marginally convex; | |
| width of diffuser | 8 mm |
| height of distribution chamber | 50 mm |
| number of slots per group on each of two sides | 5 |
| number of endmost slots per group | 2 |
| length of single slot | 2.5 mm |
| width of single slot | 0.65 mm |
| width of each group | 7.75 mm |
| length of each group (between axes of endmost slots) | 7.8 mm |
| pitch of slots | 1.3 mm |
| pitch of groups | 12.25 mm |
| diameter of central hole | 0.8 mm |

EXAMPLE 10

Burner consisting in a bank of discrete slimline diffuser elements exhibiting elongated rectangular section, for installation in an appliance with natural circulation of combusted air and gas:

| | |
|---|---|
| type of diffuser: sheet metal, marginally convex; | |
| width of diffuser | 8 mm |
| height of distribution chamber | 50 mm |
| number of slots per group on each of two sides | 5 |
| number of endmost slots per group | 2 |
| length of single slot | 2.5 mm |
| width of single slot | 0.65 mm |
| width of each group | 7.75 mm |
| length of each group (between axes of endmost slots) | 7.8 mm |
| pitch of slots | 1.3 mm |
| pitch of groups | 12.25 mm |
| diameter of 2 × central hole | 0.8 mm |
| distance between centres of central holes | 1.4 mm |

When carried into effect, the materials utilized, the dimensions and the constructional details of the invention might be other than disclosed whilst remaining equivalent in terms of the art and by no means straying from within the bounds of protection afforded by the appended claims.

For example, the topographics of the holes and slots described and illustrated are applicable not only to conventional tubular and/or slimline diffusers and their derivatives, but also to diffusers of newly conceived geometry.

We claim:

1. A method of bringing about the combustion of gases in a burner having a diffuser equipped with a plurality of slots defining an efflux area for a mixture of gas fuel and air wherein:

the slots of the diffuser are fed with a mixture of gas fuel and air having an aeration rate greater than 0.9;

the slots are arranged in groups, each group generating a slender lamellar flame;

the specific loading of the burner diffuser is comprised between 0.3 and 0.8 kW/cm$^2$ at the maximum nominal output.

2. A method, according to claim 1, wherein the slots of each group are distributed through an area of a peripheral zone encompassing an area of a central zone, the ratio between the area of the peripheral zone and the area of the central zone being comprised between 3 and 10 and the ratio between said efflux area and the area of the peripheral zone being no less than $\frac{1}{3}$.5.

3. A method according to claim 1, wherein said aeration rate is comprised between 0.9, when the burner operates at a maximum output condition, and 1.4, when the burner operates at a minimum output condition and when the burner is ignited.

4. A method according to claim 1, wherein said aeration rate is no lesser than 1.1 and no greater than 1.6, the gas fuel being supplied at a pressure comprised between 100 and 450 mbar.

5. A method according to claim 4, wherein said aeration rate is comprised between 1.1 when the burner operates at a maximum output condition, and 1.3, when the burner operates at a minimum output condition and when the burner is ignited.

6. A method according to claim 1, wherein the combusted gases are diverted by induction into a partial vacuum created by the jet of fuel-air mixture issuing from the slots to invest the external face of the lamellar flames, said combusted gases having been cooled and mixed with air at a rate of between 10 and 100%.

7. A burner for the combustion of gases, comprising a body and a diffuser equipped with a plurality of slots arranged in groups, said slots defining an efflux area for a gas/primary air mixture, wherein:

the slots of each group are distributed through an area of a peripheral zone encompassing an area of a central zone, the ratio between the area of the peripheral zone and the area of the central zone being comprised between 3 and 10; the ratio between said efflux area and the area of the peripheral zone being no lesser than $\frac{1}{3}$.0.5;

the specific loading of the burner diffuser is comprised between 0.3 and 0.8 kW/cm$^2$.

8. A burner, according to claim 7, wherein said central zone is equipped with flame stabilizing holes occupying an area not greater than 20% of the area of the central zone.

9. A burner according to claim 8, further including a variable outlet gas nozzle comprising a valve stem exhibiting a conical proportioning element having a taper angle of between 0° and 10°, said proportioning element being capable of guided axial movement through a conical orifice provided in the housing of the value, said conical orifice having a taper substantially identical to the taper angle of the proportioning element, said proportioning element being operated by a cam held in contact with a rear end thereof.

10. A burner according to claim 9, wherein said rear end is embodied as a plate, said plate being held in contact with said cam by a spring.

11. A burner, according to claim 8, comprising a bank of discrete slimline diffuser elements having an elongated rectangular section, installed in an appliance with natural circulation of combusted air and gas, each diffuser element exhibiting the following essential dimensions:

length of slot between 2 mm and 3 mm approximately;

width of slot between 0.5 mm and 0.7 mm approximately;

pitch of slots at least equal to 1.3 mm;

diameter of flame stabilizing holes between 0.6 m and 1 mm approximately;

distance between centres of flame stabilizing holes between 1.3 mm and 1.7 mm approximately;

transverse pitch of diffuser elements between 18 mm and 25 mm approximately;

distance between the topmost surface of the diffuser and the bottom surface of the heat exchanger between 80 mm and 160 mm approximately;

height of distribution chamber between a few mm and 50 mm;

pitch of groups of slots between 12 mm and 17 mm approximately; each group of slots being arranged in a peripheral zone encompassed between two ovals.

12. A burner according to claim 11, comprising a diffuser embodied in sheet metal and of marginally convex profile and responding to the following parameters:

| | |
|---|---|
| width of diffuser | 8 mm |
| height of distribution chamber | 50 mm |
| number of slots per groups of slots | 5 |
| number of endmost slots per group of slots | 2 |
| length of single slot | 2.5 mm |
| width of single slot | 0.65 mm |
| width of each group of slots | 7.75 mm |
| length of each group of slots (between axes of endmost slots) | 7.8 mm |
| pitch of slots | 1.3 mm |
| pitch of groups of slots | 12.25 mm |

13. A burner according to claim 11, comprising a diffuser embodied in sheet metal and of marginally convex profile and responding to the following parameters:

| | |
|---|---|
| width of diffuser | 8 mm |
| height of distribution chamber | 50 mm |
| number of slots per group of slots | 5 |
| number of endmost slots per group of slots | 2 |
| length of single slot | 2.5 mm |
| width of single slot | 0.65 mm |
| width of each group of slots | 7.75 mm |
| length of each group of slots (between axes of endmost slots) | 7.8 mm |
| pitch of slots | 1.3 mm |
| pitch of groups of slots | 12.25 mm |
| diameter of central hole | 0.8 mm |

14. A burner according to claim 11, comprising a diffuser embodied in sheet metal and of marginally convex profile and responding to the following parameters:

| | |
|---|---|
| width of diffuser | 8 mm |
| height of distribution chamber | 50 mm |
| number of slots per group of slots | 5 |
| number of endmost slots per group of slots | 2 |
| length of single slot | 2.5 mm |
| width of single slot | 0.65 mm |
| width of each group of slots | 7.75 mm |
| length of each group of slots (between axes of endmost slots) | 7.8 mm |
| pitch of slots | 1.3 mm |
| pitch of groups of slots | 12.25 mm |
| diameter of each of two central holes | 0.8 mm |
| distance between centres of central holes | 1.4 mm |

15. A burner, according to claim 7, wherein the diffuser is equipped with a Venturi tube.

16. A burner, according to claim 7, wherein said central zone has a width of approximately 3 mm and may be of any given length.

17. A burner, according to claim 16, wherein said central zone has a rectilinear axis.

18. A burner, according to claim 16, wherein said central zone has a curvilinear axis.

19. A burner according to claim 18, comprising a coaxially disposed internal Venturi tube exhibiting the following essential dimensions:

| | |
|---|---|
| length of diffuser | 336.5 mm |
| length of Venturi tube | 302 mm |
| diameter of Venturi throat section | 30 mm |
| diameter of Venturi outlet section | 42 mm |
| distance between the inlet of the diffuser and the farthest group of slots | 294.5 mm |

the cross sectional profile of the diffuser comprising a pair of opposed and downwardly convergent curvilinear sides interconnected at bottom by an interconnecting arc and connected through further arcs to a curvilinear top stretch; the diffuser having the following essential dimensions:

| | |
|---|---|
| height of diffuser | 82.9 mm |
| width of diffuser | 54.5 mm |
| radius of curvature of each side | 156 mm |
| radius of curvature of the top stretch | 44.2 mm |
| radius of the interconnecting arc | 23.7 mm |
| radius of further arcs | 13 mm |

the centres of the interconnecting arc and further arcs coinciding with a vertical axis of symmetry of the diffuser; the centres of the sides being situated at a distance of 13.5 mm from a horizontal axis on either side of the vertical axis of symmetry;

the slots of each group of slots exhibiting the following topography:

| | |
|---|---|
| width of a single slot | 0.5 mm |
| distance between centres of adjacent slots | 1.25 mm |
| number of slots | 14 |

the slots being disposed with axes mutually parallel and within a peripheral zone, bordering internally on a rhombus with diagonals having a length of 6.1 mm and 5.5 mm respectively and encompassed by a regular octagon with apothem of 5.75 mm approx.;

the groups of slots being distributed along the topmost surface of the diffuser in four longitudinal rows staggered one from the next by a distance less than half the distance between adjacent groups of slots in a same row; the groups of slots being distributed with a transverse pitch of 14 mm and a longitudinal pitch of 26 mm.

20. A burner, according to claim 16, wherein said central zone has an axis of zigzag geometry.

21. A burner, according to claim 16, wherein said central zone has an axis of mixed geometry.

22. A burner, according to claim 7, wherein the body of the burner exhibits a cross section having a bilobed profile with two lobes downwardly directed which define two lateral channels at bottom, the diffuser having a substantially flat and slightly convex profile, said lobes being equipped with inlet ports for the fuel and air mixture, a longitudinal baffle of upturned minuscule omega profile extending through the entire length of the body of the burner to define two diverging ducts of sinuous curvilinear axis and progressively increasing cross section.

23. A burner according to claim 7, wherein said peripheral zone is defined by a pair of concentric circles and said central zone has a radius not greater than 3.5 mm.

24. A burner, according to claim 23, wherein each group of slots consists of alternate rectangular and triangular slots disposed in a substantially radial direction.

25. A burner, according to claim 23, wherein each group of slots consists of rectangular slots parallel to each other.

26. A burner, according to claim 23, wherein each group of slots consists of sub-groups distributed through said peripheral zone with a substantially constant angular pitch.

27. A burner, according to claim 23, wherein each group of slots consists of alternate radially disposed slots of different length.

28. A burner, according to claim 23, wherein the slots of each group are disposed through two or more concentric circles.

29. A burner, according to claim 23, wherein the slots of each group are disposed through two or more concentric oblongated circles.

30. A burner according to claim 7, wherein said peripheral zone is defined by a pair of concentric ellipses and said central zone has a radius not greater than 3.5 mm.

31. A burner according to claim 7, further comprising a compressor operating at delivery pressures between 100 and 450 mbar to obtain forced circulation of combusted air and gas, said compressor being provided with an outlet branched to obtain a partial recirculation of the delivery flow, and with an inlet connected to alternating on-off valves controlling air and gas supply lines.

32. A burner according to claim 7, comprising:

a body provided with a diffuser pierced over an area having a length less than the length of the diffuser; said body having a cross section exhibiting a ratio between the height and the width of the section greater than 1.5;

a Venturi tube shaped so as to obtain a mean velocity of a gas/air mixture through an outlet end of the tube equal to or less than 4 m/s, said Venturi tube having a length exceeding the length of said area of the diffuser by a quantity comprised between 50% and 150% of said the outlet end dimensions the distance between said outlet end and an end wall of the diffuser being selected so that the mean velocity of the gas/air mixture at inversion is greater than 2 m/s; an annular section being defined between said diffuser and said Venturi tube through which said gas/air mixture has a mean velocity no greater than 2 m/s;

groups of slots distributed at least over a topmost surface of said diffuser over an area such as to determine a specific loading on the diffuser of less than 0.7 kW/cm$^2$; said slots being arranged around a central zone;

said groups of slots being distributed in ranks, transverse to the diffuser axis, set apart one from the next by a distance at least equal to 65% of the maximum transverse dimension of the group of slots, with an axial distance between the groups of slots of two adjacent not less than nd/2, where d is the axial dimension of the single group and n is the number of groups in one rank.

33. A burner, according to claim 32, wherein complementary holes are provided between adjacent slots.

34. A burner, according to claim 32, wherein said slots have a circular shape.

35. A burner, according to claim 32, wherein said slots have a poligonal shape.

36. A burner, according to claim 32, wherein said slots have a non-circular and non-poligonal shape.

37. A burner, according to claim 32, wherein said central area is pierced with holes.

38. A burner, according to claim 32, wherein said groups of slots form a chequered pattern, n being the number of groups of slots in two adjacent ranks of groups of slots.

39. A burner according to claim 7, wherein the diffuser exhibits a tubular profile; the groups of slots being distributed over the entire surface of the diffuser and ordered in ranks with groups separated one from the next by a distance at least equal to 65% of the maximum dimensions of the group as measured along the direction of separation; the burner further comprising a mixing device for mixing air and gas fuel and a compressor operating at delivery pressures between 100 and 450 mbar to obtain forced circulation of combusted air and gas, said compressor being provided with an outlet branched to obtain a partial recirculation of the delivery flow, and with an inlet connected to alternating on-off valves controlling air and gas supply lines.

40. A burner according to claim 7, embodied in matching halves, comprising:

a Venturi tube having a curvilinear axis and a diffuser:

an essentially tall mixing and distribution chamber having an elongated rectangular cross section, said distribution chamber being inserted between an outlet section of the Venturi tube and the diffuser;

groups of slots aligned longitudinally along a topmost surface of the diffuser and set apart one from the next at a distance less than half the longitudinal dimension of the group.

41. A burner, according to claim 7, comprising a coaxially disposed internal Venturi tube, exhibiting the following essential dimensions.

| | |
|---|---|
| length of diffuser | 394.6 mm |
| length of Venturi tube | 359 mm |
| diameter of Venturi throat section | 26 mm |
| diameter of Venturi outlet section | 35 mm |
| distance between the inlet of the diffuser and the farthest group of slots | 324 mm |

the cross sectional profile of the diffuser consisting in a pair of opposed upwardly convergent curvilinear sides interconnected uppermost by a top interconnecting arc and connected at bottom through further arcs to a curvilinear base, the diffuser having the following essential dimensions:

| | |
|---|---|
| height of diffuser | 61.3 mm |
| width of diffuser | 51.5 mm |
| radius of curvature of each side | 76 mm |
| radius of curvature of the base | 45.5 mm |
| radius of top interconnecting arc | 23 mm |
| radius of further arcs | 13 mm |

the centres of the base of the diffuser and of the top interconnecting arc coinciding with a vertical axis of symmetry of the diffuser;

the centres of the opposite sides of the diffuser coinciding with a horizontal axis on either side of the vertical axis of symmetry;

the slots of each group exhibiting the following topography:

| | |
|---|---|
| width of a single slot | 0.5 mm |
| distance between centres of adjacent slots | 1.25 mm |
| number of slots | 14 |

the slots being disposed with axes mutually parallel, within a peripheral zone bordering internally on a rhombus, having diagonals exhibiting a length of 6.1 mm and 5.5 mm respectively, and encompassed by a regular octagon with apothem of 5.75 mm approx.;

the groups of slots being distributed along the topmost surface of the diffuser in four longitudinal rows staggered one from the next by a distance less than half the distance between adjacent groups of slots in a same row, the groups of slots being distributed with a transverse pitch of 13 mm and a longitudinal pitch of 26 mm.

42. A burner according to claim 7, comprising a coaxially disposed internal Venturi tube exhibiting the following essential dimensions:

| | |
|---|---|
| length of diffuser | 325.6 mm |
| length of Venturi tube | 290 mm |
| diameter of Venturi throat section | 26 mm |
| diameter of Venturi outlet section | 35 mm |
| distance between the inlet of the diffuser and the farthest group of slots | 290.6 mm |

the cross sectional profile of the diffuser comprising a pair of opposed and downwardly convergent curvilinear sides interconnected at bottom by an interconnecting arc and connected through further arcs to a curvilinear top stretch; the diffuser having the following essential dimensions:

| | |
|---|---|
| height of diffuser | 61.3 mm |
| width of diffuser | 51.5 mm |
| radius of curvature of each side | 76 mm |
| radius of curvature of the top stretch | 45.5 mm |
| radius of the interconnecting arc | 23 mm |
| radius of further arcs | 13 mm |

the centres of the interconnecting arc and further arcs coinciding with a vertical axis of symmetry of the diffuser; the centres of the sides coinciding with a horizontal axis on either side of the vertical axis of symmetry;

the slots of each group of slots exhibiting the following topography:

| | |
|---|---|
| width of a single slot | 0.5 mm |

-continued

| | |
|---|---|
| distance between centres of adjacent slots | 1.25 mm |
| number of slots | 14 |

the slots being disposed with axes mutually parallel and within a peripheral zone, bordering internally on a rhombus with diagonals having a length of 6.1 mm and 5.5 mm respectively and encompassed by a regular octagon with apothem of 5.75 mm approx.; the groups of slots being distributed along the topmost surface of the diffuser in four longitudinal rows staggered one from the next by a distance less than half the distance between adjacent groups of slots in a same row; the groups of slots being distributed with a transverse pitch of 13 mm and a longitudinal pitch of 29.5 mm.

* * * * *